US012369652B1

(12) United States Patent
Blacker

(10) Patent No.: US 12,369,652 B1
(45) Date of Patent: Jul. 29, 2025

(54) MEDICAL GARMENT(S)

(71) Applicant: Marcambria, LLC, Castle Rock, CO (US)

(72) Inventor: Virginia Jeanne Blacker, Castle Rock, CO (US)

(73) Assignee: Marcambria, LLC, Castle Rock, CO (US)

( * ) Notice: Subject to any disclaimer, the term of this patent is extended or adjusted under 35 U.S.C. 154(b) by 0 days.

(21) Appl. No.: 18/779,910

(22) Filed: Jul. 22, 2024

(51) Int. Cl.
*A41C 3/00* (2006.01)
*A41C 3/12* (2006.01)

(52) U.S. Cl.
CPC ..... *A41C 3/0064* (2013.01); *A41C 3/12* (2013.01)

(58) Field of Classification Search
CPC ..... A41C 3/12; A41C 3/0014; A41C 3/0064; A41C 1/10; A41F 15/00; A41F 15/005
USPC ..... 450/1
See application file for complete search history.

(56) References Cited

U.S. PATENT DOCUMENTS 2,402,292 A * 6/1946 Nichols ..... A41D 27/26 2/268
4,073,299 A * 2/1978 Murata ..... D05C 17/00 428/906.6
5,507,682 A * 4/1996 Grahammer ..... A41F 15/005 2/243.1
6,935,921 B1 * 8/2005 Eudenbach ..... A41C 3/02 450/54
7,666,059 B2 * 2/2010 Falla ..... B29C 51/004 2/268
D627,948 S * 11/2010 Astrom ..... D2/706
8,414,352 B2 * 4/2013 Trenhaile ..... A41C 3/08 450/32
8,545,288 B1 * 10/2013 Abood ..... A41C 3/00 450/67
8,840,443 B2 * 9/2014 Kadium ..... A41C 3/148 450/79
9,615,616 B2 4/2017 Corrado et al.
9,993,035 B2 6/2018 Roman
10,238,160 B1 * 3/2019 Mabon ..... A41F 15/002
11,503,864 B1 11/2022 Clarke
(Continued)

FOREIGN PATENT DOCUMENTS

CN 1301509 A 7/2001
CN 2860134 Y 1/2007
(Continued)

OTHER PUBLICATIONS

The Rachel Unilateral Bra Collection | Ana Ono. (n.d.). https://www.anaono.com/collections/rachel-unilateral-bra-collection.
(Continued)

*Primary Examiner* — Timothy K Trieu
(74) *Attorney, Agent, or Firm* — Stephen B. Katsaros; Patent Engineering, LLC

(57) ABSTRACT

The present disclosure relates to a medical garment. The medical garment may include a single strap brassiere, post-surgery or compression vests, and the like. The single-strap brassiere may include a single-strap configuration, i.e., a single strap. When worn by a user, the single strap may be positioned over the user's collarbone. Particularly, the single strap may be positioned at a collarbone which may be distant from a surgical site, thereby preventing contact of the strap thereto.

11 Claims, 16 Drawing Sheets

(56) References Cited

U.S. PATENT DOCUMENTS

| | | | | |
|---|---|---|---|---|
| 2008/0060745 | A1* | 3/2008 | Lau | B29C 66/45 450/86 |
| 2010/0093258 | A1* | 4/2010 | Glenn | D03D 17/00 2/243.1 |
| 2011/0269376 | A1* | 11/2011 | Clim | A41F 15/00 450/86 |
| 2012/0060252 | A1* | 3/2012 | Morales Montes | A41D 27/08 2/244 |
| 2015/0289571 | A1* | 10/2015 | Yamamoto | A41C 3/148 450/55 |
| 2016/0278461 | A1* | 9/2016 | Corrado | A41C 3/02 |
| 2019/0116890 | A1* | 4/2019 | Poirier | A41C 3/08 |
| 2019/0307601 | A1 | 10/2019 | Hittman et al. | |
| 2022/0087330 | A1* | 3/2022 | Yildiz | G21F 3/02 |
| 2023/0397673 | A1 | 12/2023 | Kallile et al. | |

FOREIGN PATENT DOCUMENTS

| | | | |
|---|---|---|---|
| WO | 2006072713 | A1 | 7/2006 |
| WO | 2020076978 | A1 | 4/2020 |

OTHER PUBLICATIONS

Prairie Wear. (n.d.). Prairie wear. https://www.prairiewear.com/. Printed May 23, 2025.

* cited by examiner

MEDICAL GARMENT(S)

TECHNICAL FIELD

This disclosure pertains, but not by way of limitation, to the field of garments. More particularly, the disclosure relates to the field of medical garments for patients with a surgical site such as a chemotherapy port, or post-surgery patients.

BACKGROUND

Existing garments, such as brassieres may include a two-strap configuration that passes over a user's collarbone. However, for users including female cancer patients having a chemotherapy port, such as a Broviac port, or female cardiac patients having a pacemaker implant, such two-strap configurations of the brassieres may inadvertently contact the chemotherapy port or the implant, thereby inflicting unnecessary pain and irritation.

SUMMARY

To this end, a medical garment is disclosed. The medical garment may include a single-strap configuration, i.e., the medical garment may include a single strap. When worn, the single strap may be positioned over the user's collarbone. Particularly, the single strap may be positioned at a collarbone distant from a surgical site. Further, the medical garment may include a front closure system, a rear closure system, at least one passive cooling attachment, and the like. While specific examples, configurations, and/or applications of the present medical garment(s) are provided, it is to be understood that granted claims define the breadth and depth of the present disclosure. The following example(s) on the medical garment(s) illustrates the medical garment (s).

In an illustrative configuration, a medical garment is disclosed. The medical garment may include a front panel. The front panel may include a front panel proximal edge, a front panel distal edge oppositely disposed to the front panel proximal edge, and a front closure system disposed between the front panel proximal edge and the front panel distal edge. The medical garment may include a rear panel attached to the front panel via a seaming attachment. Further, the rear panel may include a rear panel proximal edge, a rear panel distal edge oppositely disposed to the rear panel proximal edge, and a rear closure system disposed between the rear panel proximal edge and the rear panel distal edge. Further, the medical garment may include a strap. The strap may include a first strap portion connected to the front panel proximal edge at a first transpose angle. Further, the first strap portion may include a first strap width. Further, the strap may include a second strap portion connected to the rear panel proximal edge at a second transpose angle. Further, the second strap portion may include a second strap width. Further, the strap may include an intermediate strap portion disposed between the first strap portion and the second strap portion. The intermediate strap portion may include an intermediate strap width to cover the shoulder of a user. Further, the medical garment is configurable between a first condition and a second condition after the first condition. In the first condition, the medical garment is readily worn by a user. In the second condition, the intermediate strap portion is diverted over a collarbone distal to a surgical site positioned at the user's chest, such that contact of the strap with the surgical site is prevented.

In an illustrative configuration, a contact prevention method to prevent contact of a portion of a medical garment with a surgical site of a user is disclosed. The contact prevention method may include a first step, in which a front panel may be provided. The front panel may include a front panel proximal edge, a front panel distal edge oppositely disposed to the front panel proximal edge, and a front closure system disposed between the front panel proximal edge and the front panel distal edge. In the next step, a rear panel may be provided. The rear panel is attached to the front panel via a seaming attachment. Further, the rear panel may include a rear panel proximal edge, a rear panel distal edge oppositely disposed to the rear panel proximal edge and a rear closure system disposed between the rear panel proximal edge and the rear panel distal edge. In the next step, a strap may be provided. The strap may include a first strap portion connected to the front panel proximal edge at a first transpose angle. Further, the first strap portion may include a first strap width. Further, the strap may include a second strap portion connected to the rear panel proximal edge at a second transpose angle. Further, the second strap portion may include a second strap width. Further, the strap may include an intermediate strap portion disposed between the first strap portion and the second strap portion. The intermediate strap portion may include an intermediate strap width to cover the user's shoulder. In the next step, the medical garment may be configured between a first condition and a second condition. In the first condition, the medical garment is readily worn by a user, and in the second condition, the intermediate strap portion is diverted over a collarbone distal to a surgical site positioned at the user's chest, such that a contact of the strap with the surgical site is prevented.

In an illustrative configuration, a medical garment is disclosed. The medical garment may include a front panel. The front panel may include a front panel proximal edge, a front panel distal edge oppositely disposed to the front panel proximal edge, and a front closure system disposed between the front panel proximal edge and the front panel distal edge. The medical garment may include a rear panel attached to the front panel via a seaming attachment. Further, the rear panel may include a rear panel proximal edge, a rear panel distal edge oppositely disposed to the rear panel proximal edge, and a rear closure system disposed between the rear panel proximal edge and the rear panel distal edge. Further, the medical garment may include a strap. The strap may include a first strap portion connected to the front panel proximal edge at a first transpose angle. Further, the first strap portion may include a first strap width. Further, the strap may include a second strap portion connected to the rear panel proximal edge at a second transpose angle. Further, the second strap portion may include a second strap width. Further, the strap may include an intermediate strap portion disposed between the first and second straps. The intermediate strap portion may include an intermediate strap width to cover the shoulder of a user. Further, each of the first strap portion, the second strap portion, and the intermediate strap portion may include a front strap surface and a rear strap surface oppositely disposed to the front strap surface. Further, the medical garment may include a passive cooling attachment, which may include a plurality of flaps, wherein each flap is separated from a sequential flap by a V-shaped gap. Further, the medical garment may include an engaging arrangement in which the plurality of flaps are engaged to at least one of the front panel and the strap.

Further areas of applicability of the present disclosure will become apparent from the detailed description provided hereinafter. It should be understood that the detailed description and specific examples while indicating various configurations, are intended for purposes of illustration only and are not intended to necessarily limit the scope of the disclosure.

BRIEF DESCRIPTION OF THE DRAWINGS

The accompanying figures of the drawing, which are included to provide a further understanding of general aspects of the system/method, are incorporated in and constitute a part of this specification. These illustrative aspects of the system/method, and together with the detailed description, explain the principles of the system. No attempt is made to show structural details in more detail than is necessary for a fundamental understanding of the system and various ways in which it is practiced. The following figures of the drawing include.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label. Where the reference label is used in the specification, the description is applicable to any one of the similar components having the same reference label.

DETAILED DESCRIPTION

Illustrative configurations are described with reference to the accompanying drawings. Wherever convenient, the same reference numbers are used throughout the drawings to refer to the same or similar parts. While examples and features of disclosed principles are described herein, modifications, adaptations, and other implementations are possible without departing from the spirit and scope of the disclosed configurations. It is intended that the following detailed description be considered exemplary only, with the true scope and spirit being indicated by the following claims.

As explained earlier, the two-strap configuration of brassieres may inadvertently contact the chemotherapy port, thereby inflicting unnecessary pain and irritation to the users such as female patients. Additionally, current brassiere configurations may lack various attachment points on which a user may attach an ice pack or a heat pack, particularly around the portion that may be painful or require medical attention.

In an effort to prevent pain and irritation for patients, especially for female patients, due to continuous contact of a portion of a brassiere (such as straps) with a surgical site such as a chemotherapy port or pacemaker implant, illustrative configurations of medical garment(s) are disclosed. The medical garment may include, but is not limited to, a single-strap brassiere, post-surgery compression vests, post-surgery trousers, and the like. Further, the medical garment(s) such as the single-strap brassiere may include a single strap. The strap may pass over a collarbone distal to the surgical site. Accordingly, contact of the strap with the surgical site may be prevented.

Figure 1:
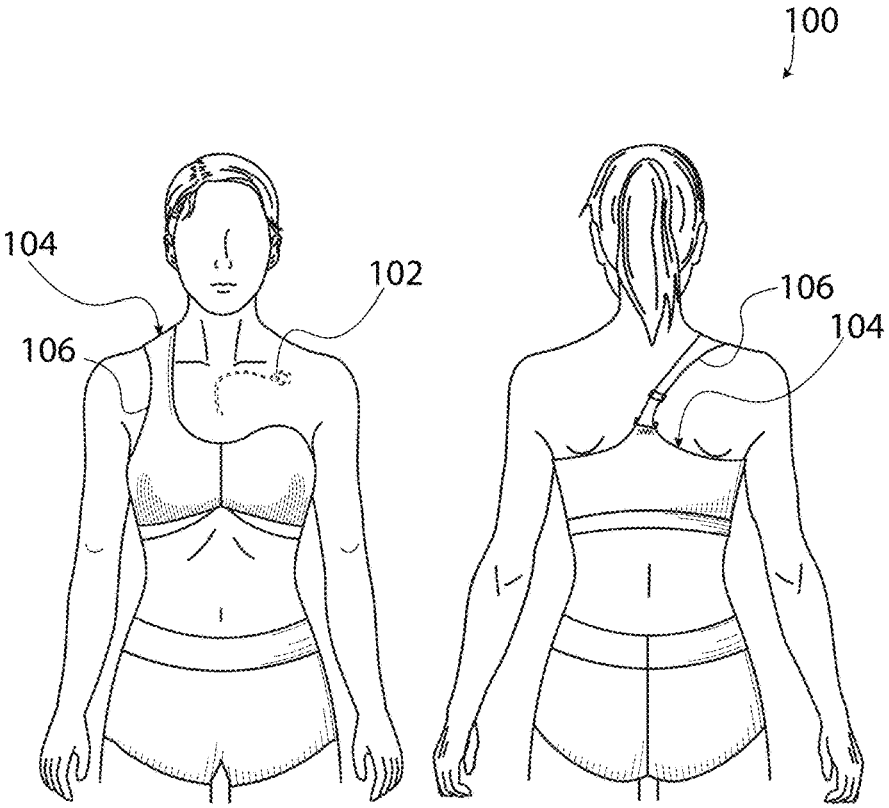
FIG. 1 illustrates various schematic views of a user wearing a medical garment.

Now, FIG. 1 illustrates various views 100 of a user wearing a medical garment 104. As seen, the user may have a surgical site 102 on a chest thereof. The surgical site 102 may be located at the chest of the user at which a chemotherapy port or a pacemaker implant may be placed. The medical garment 104 may include a strap 106, which, as explained earlier, may pass over the collarbone distal to the surgical site 102. The strap 106 may be formed at an angle transpose to at least one panel of the medical garment 104. Accordingly, such transposed positioning of the strap 106 may allow diversion thereof from the surgical site 102, as well as complete support of the medical garment 104 over the collarbone of the user. Such support also ensures medically necessary support to one or more portions of the user's body, for example, the breasts. This is explained in detail in conjunction with FIGS. 2-6.

Figure 2:
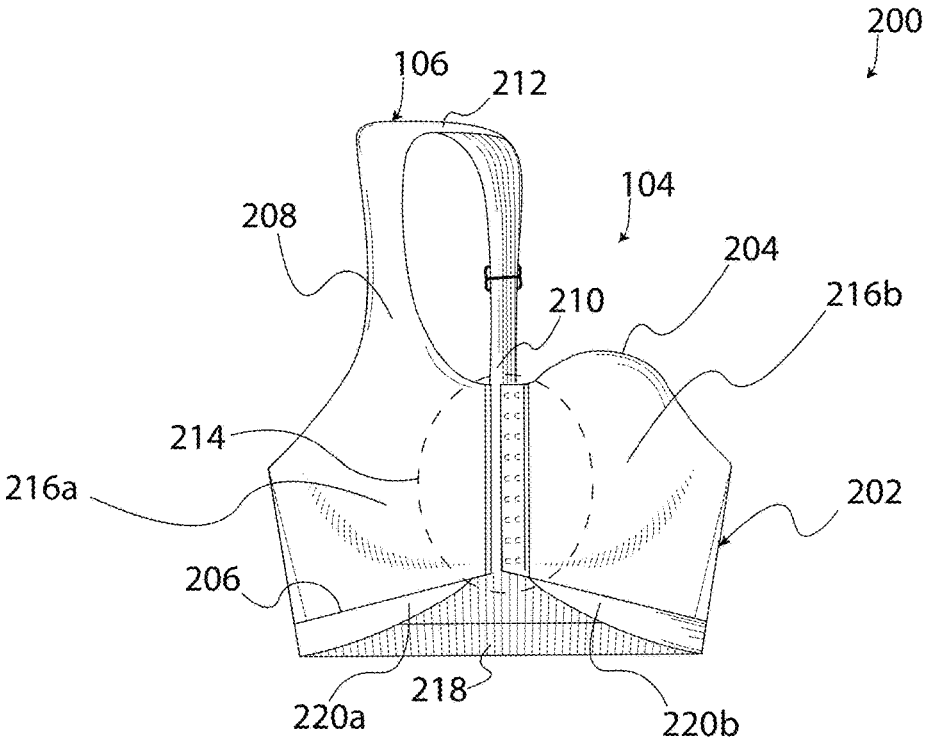
FIG. 2 illustrates a front view of the medical garment.
Figure 3:
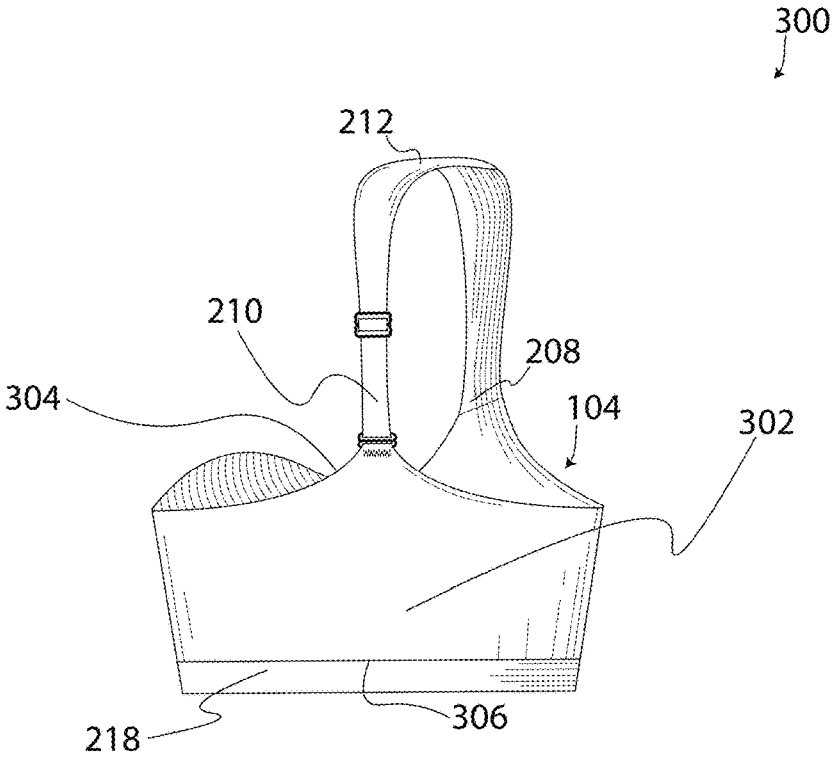
FIG. 3 illustrates a rear view of the medical garment.
Figure 4:
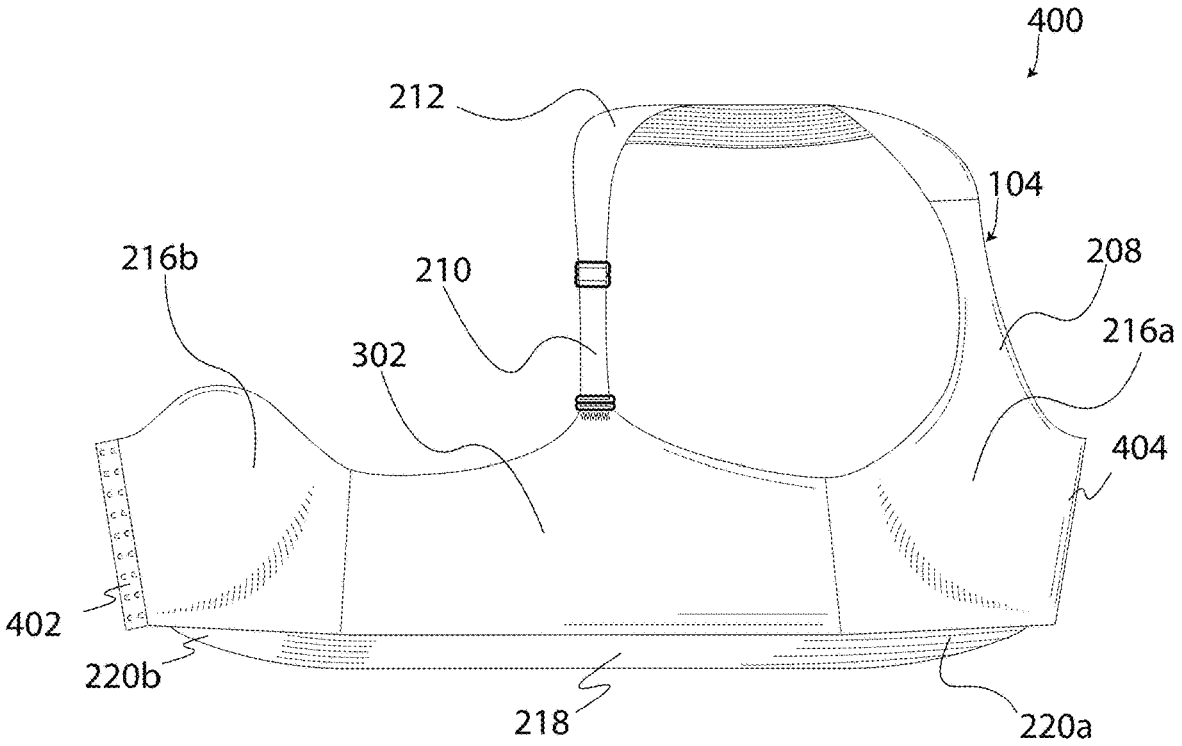
FIG. 4 illustrates a rear view of another configuration of the medical garment.
Figure 5:
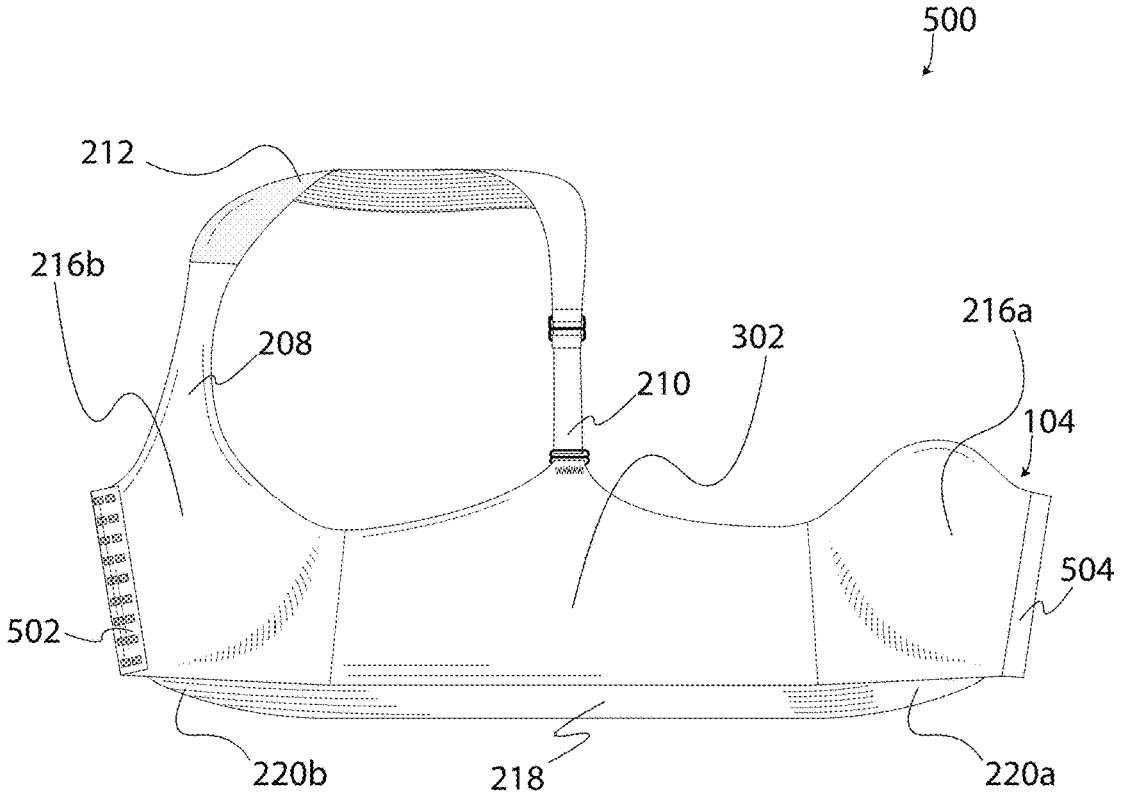
FIG. 5 illustrates a rear view of another configuration of the medical garment in an opened condition.
Figure 6:
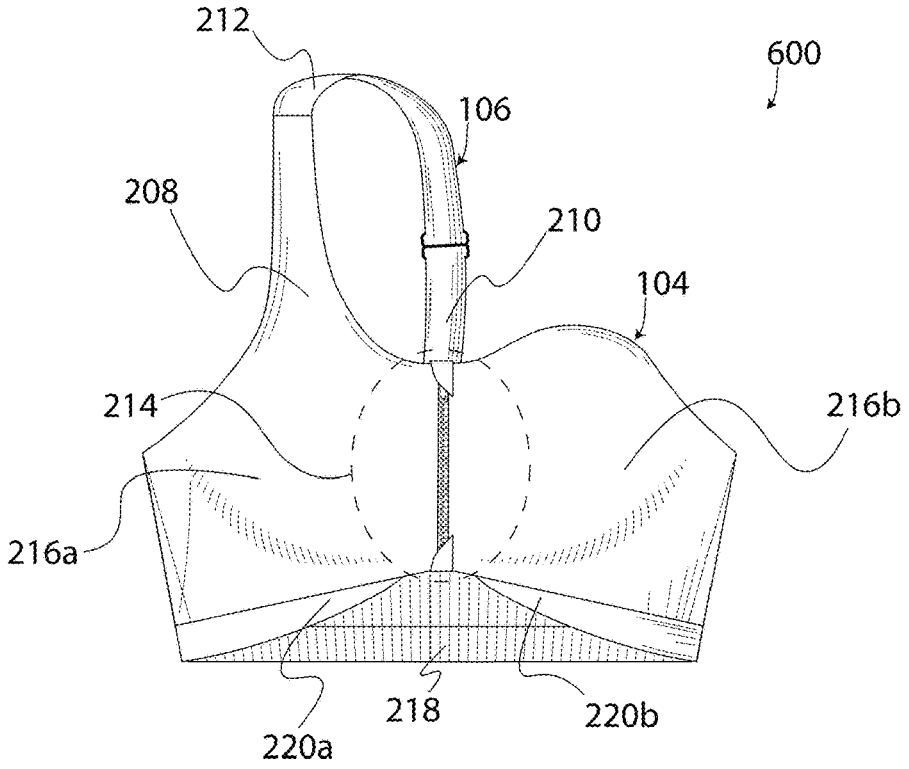
FIG. 6 illustrates a front view of another configuration of the medical garment in a closed condition.

Now, FIG. 2 illustrates a front view 200 of the medical garment 104, FIG. 3 illustrates a rear view 300 of the medical garment 104, and FIG. 4 illustrates a rear view 400 of the medical garment 104 in an opened condition. Further, FIG. 5 illustrates a rear view 500 of another configuration of the medical garment 104 in the opened condition, and FIG. 6 illustrates a front view 600 of another configuration of the medical garment 104 in a closed condition.

It must be noted that the opened condition may be interchangeably referred to as a first condition, and the closed condition may be interchangeably referred to as a second condition. In the first condition, the medical garment 104 may be opened and readily worn by the user thereafter. In contrast, the second condition may be attained after the first condition, in which after wearing the medical garment 104, the strap 106 may be diverted over the collarbone distal from the surgical site 102.

In an illustrative configuration, the medical garment 104 may include a front panel 202 and a rear panel (illustrated as rear panel 302 in FIG. 3) attached to the front panel 202. Further, the strap 106 may be attached to the front panel 202 and the rear panel 302. Particularly, the strap 106 may include a first strap portion 208, a second strap portion 210, and an intermediate strap portion 212 disposed between the first strap portion 208 and the second strap portion 210. The first strap portion 208 may be attached, or formed at the front panel 202, and the second strap portion 210 may be attached or formed to the rear panel 302.

It must be noted that the front panel 202, the rear panel 302, and the strap 106 may be formed as a single-piece structure, or may be attached using various seaming methods, such as for example, thermally bonded seams. Thermally bonded seams are created using heat to join materials together without sewing. In this scenario, the edges of the front panel 202, the rear panel 302, and the strap 106 may be thermally bonded to form a single structure of the medical garment 104.

In an illustrative configuration, with continued reference to FIGS. 3-6, the front panel 202 may include a front panel proximal edge 204, and a front panel distal edge 206. Similarly, the rear panel 302 may include a rear panel proximal edge 304 and a rear panel distal edge 306. As explained earlier, strap 106 may be adjoined to the front panel 202 and the rear panel 302. Particularly, the first strap portion 208 of strap 106 may be adjoined or formed to the front panel proximal edge 204, and the second strap portion 210 of strap 106 may be adjoined to the rear panel proximal edge 304.

In an illustrative configuration, the medical garment 104 may include an underband. The underband may be collectively formed by a linear underband portion 218, a first converging portion 220*a*, and a second converging portion 220*b*. The linear underband portion 218 may be formed in line with the rear panel distal edge 306, and the first converging portion 220*a* and the second converging portion 220*b* may be formed in line with the front panel distal edge 206. In the same configuration, front panel 202 may include a first cup 216*a* and a second cup 216*b*. The first converging portion 220*a* may be placed below the first cup 216*a*, and the second converging portion 220*b* may be placed below the second cup 216*b*.

At least one of the first cup 216*a* and the second cup 216*b* may include a cutout portion (not shown in figures). Further, at least one of the first cup 216*a* may include an enclosure formed therein, which may be connected to the cutout portion. The enclosure may be configured to accommodate a mastectomy form.

As the name suggests, the first converging portion 220*a*, and the second converging portion 220*b* may converge towards a central position of the front panel 202. For example, a width of the first converging portion 220*a* and the second converging portion 220*b* at the lateral edges of the front panel 202 may converge or gradually decrease towards the center of the front panel 202. As such, when the user wears the medical garment 104, the linear underband portion 218, the first converging portion 220*a*, and the second converging portion 220*b* may be fitted snugly around the user's ribcage. Accordingly, the linear underband portion 218, in addition to the first converging portion 220*a* and the second converging portion 220*b*, may not roll-over upwards on the user's body, and hence may anchor the medical garment 104 to the user's body.

In an illustrative configuration, the front panel 202 may include a front closure portion 214. The front closure portion 214 may include a fastening system disposed between the first cup 216*a*, and the second cup 216*b*. For example, when the user wears the medical garment 104, the front closure portion 214 may be configured to adjoin the first cup 216*a* and the second cup 216*b*. Advantageously, without any closure or fastening mechanism at the rear panel 302, a smooth silhouette may result at the back of the user, especially when an article of clothing (for example, a blouse, shirt, etc.) may be worn by the user. Accordingly, lack of rear closure will enhance comfort by minimizing bulk (due to the smooth silhouette) while the user may lean back or lay in full recline.

In an illustrative configuration, the front closure portion 214 may include, but is not limited to, a hook and clasp mechanism, a zipper mechanism, a hook and loop mechanism, and the like. For example, referring to FIG. 2-4, the front closure portion 214 may include the hook and clasp mechanism. Particularly, the front closure portion 214 illustrated in FIGS. 2-4 may include a hook portion 402 adjoined to the second cup 220*b*, and a clasp portion 404 may be adjoined to the first cup 220*a*. When worn, the hook portion 402 may engage the clasp portion 404 to adjoin the first cup 216*a* and the second cup 216*b*.

In an illustrative configuration, with continued reference to FIGS. 5-6, the front closure portion 214 may include a hook and loop attachment mechanism, or in other words, a Velcro attachment. Particularly, the front closure portion 214 may include a hook 502 and a loop 504. Similar to the front closure portion 214, as illustrated in FIG. 4, the hook 502 may be adjoined to the second cup 220*b*, and the loop 504 may be adjoined to the first cup 220*a*. Accordingly, the hook 502 may be engaged with the loop 504, such that the first cup 216*a* may be adjoined to the second cup 216*b*. As such, some configurations of the front closure portion 214 may also include a zipper-closure mechanism (refer to FIG. 6). The zipper-closure mechanism may be configured to adjoin the first cup 216*a* and the second cup 216*b*, similar to the hook and loop mechanism and the hook and clasp mechanism.

In an illustrative configuration, in addition to the front closure portion 214, the medical garment 104 may also include a rear closure portion. The rear closure portion may be formed, or attached to the linear underband portion 218. The rear closure portion may be formed along with an undercut portion, on the rear panel 302. This is explained in conjunction with FIGS. 7-9.

Figure 7:
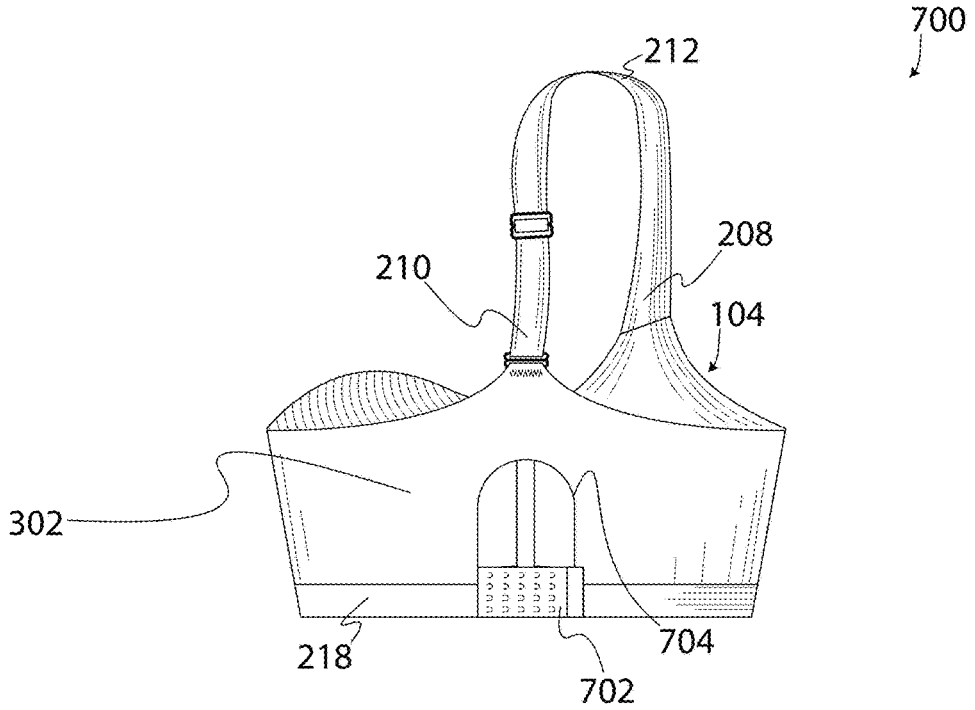
FIG. 7 illustrates a rear view of another configuration of the medical garment.
Figure 8:
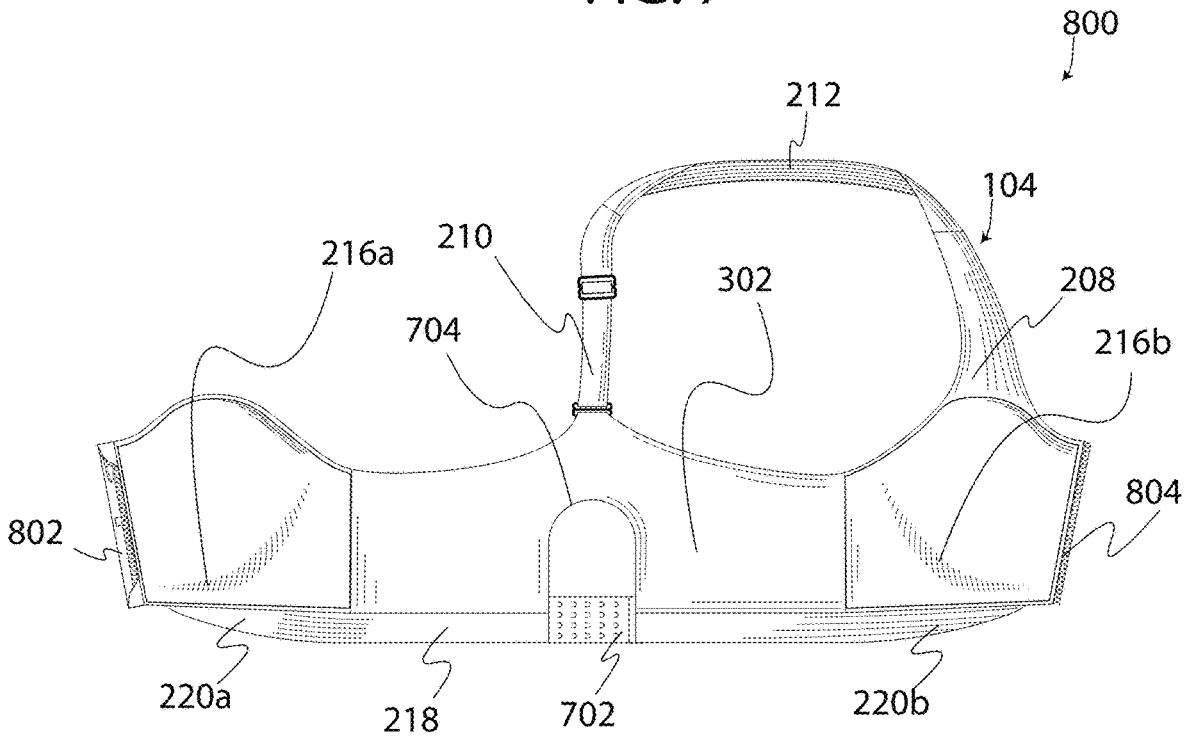
FIG. 8 illustrates a rear view of another configuration of the medical garment in the opened condition.
Figure 9:
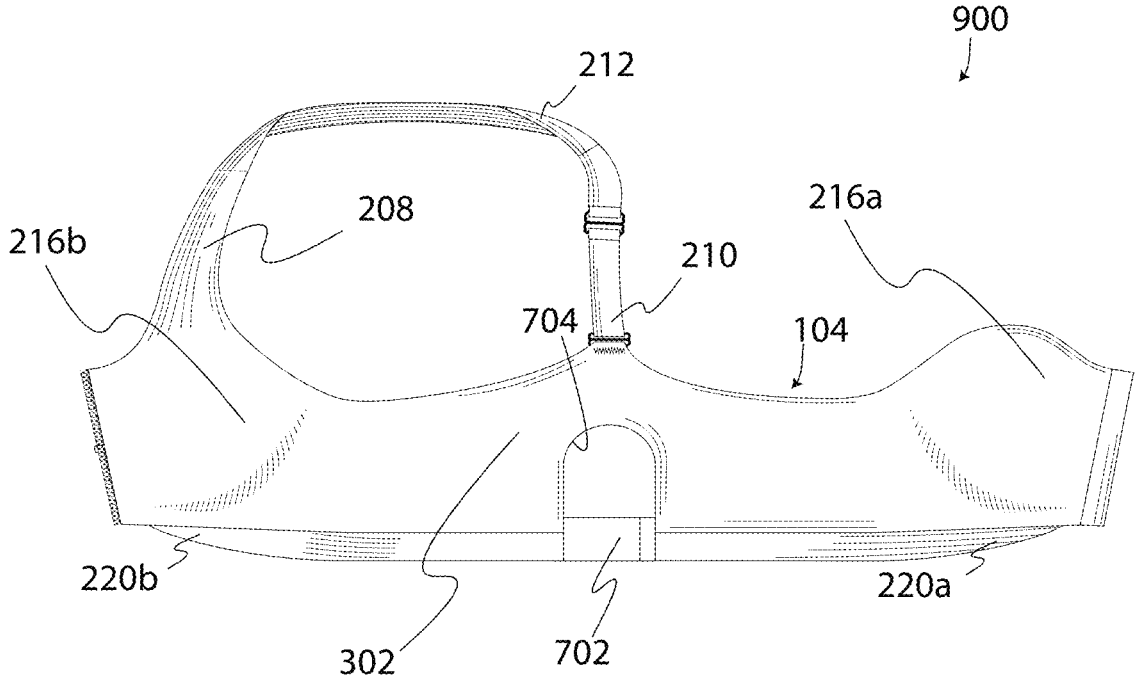
FIG. 9 illustrates a front view of another configuration of the medical garment in the opened condition.

Now, FIG. 7 illustrates a rear view 700 of another configuration of the medical garment 104, FIG. 8 illustrates a rear view 800 of another configuration of the medical garment 104 in the opened condition, and FIG. 9 illustrates a front view 900 of another configuration of the medical garment 104 in the opened condition.

In an illustrative configuration, and explained earlier, the medical garment 104 may include a rear closure portion 702. Similar to front closure portion 214, the rear closure portion 702 may also include, but not limited to, a hook and clasp mechanism, a zipper mechanism, a hook and loop mechanism, and the like. For example, with reference to FIG. 7, the rear closure portion 702 may include a hook and clasp mechanism. Further, the rear closure portion 702 may be formed in line to the linear underband portion 218, and hence, when engaged may be configured to enhance snugly fitting of the underband around the user's ribcage.

In an illustrative configuration, and with continued reference to FIGS. 7-9, the medical garment 104 may include a cutout portion 704. The cutout portion 704 may be disposed above the rear closure portion 702. Further, the cutout portion 704 may include, but is not limited to, an inverse U-shaped cut, a V-shaped cut, a scooped cut, and the like. Further, the cutout portion 704 may be configured to follow the natural contours of the user's body, providing a more personalized and comfortable fit, especially when the rear closure portion 702 may be tightened for prolonged periods.

In an illustrative configuration and explained earlier, the rear closure portion 702, and the cutout portion 704 may be additionally formed with the front closure portion 214. For example, referring to FIG. 8, the medical garment 104 may include the front closure portion 214, which may include a zipper mechanism formed by first zipper teeth 802 and second zipper teeth 804. Furthermore, the medical garment 104 may include the rear closure portion 702 and the cutout portion 704. As such, in this configuration, the front closure portion 214 enables convenient wearability of the medical garment 104 when the first zipper teeth 802 and the second zipper teeth 804 may be engaged, while the rear closure portion 702 provides customizable fit adjustment for the medical garment 104.

As known, medical garment 104 may be made of soft fabric. Accordingly, the medical garment 104 may align with the contours of the user's body. However, such alignment does not necessitate a proper form of the medical garment 104 and may not enable proper support to the user's various body parts such as the breasts. Therefore, to maintain proper form of the medical garment 104 and to provide necessary support to the user's various body parts, the medical garment 104 may include an underwire. This is explained in detail in conjunction with FIGS. 10-11.

Figure 10:
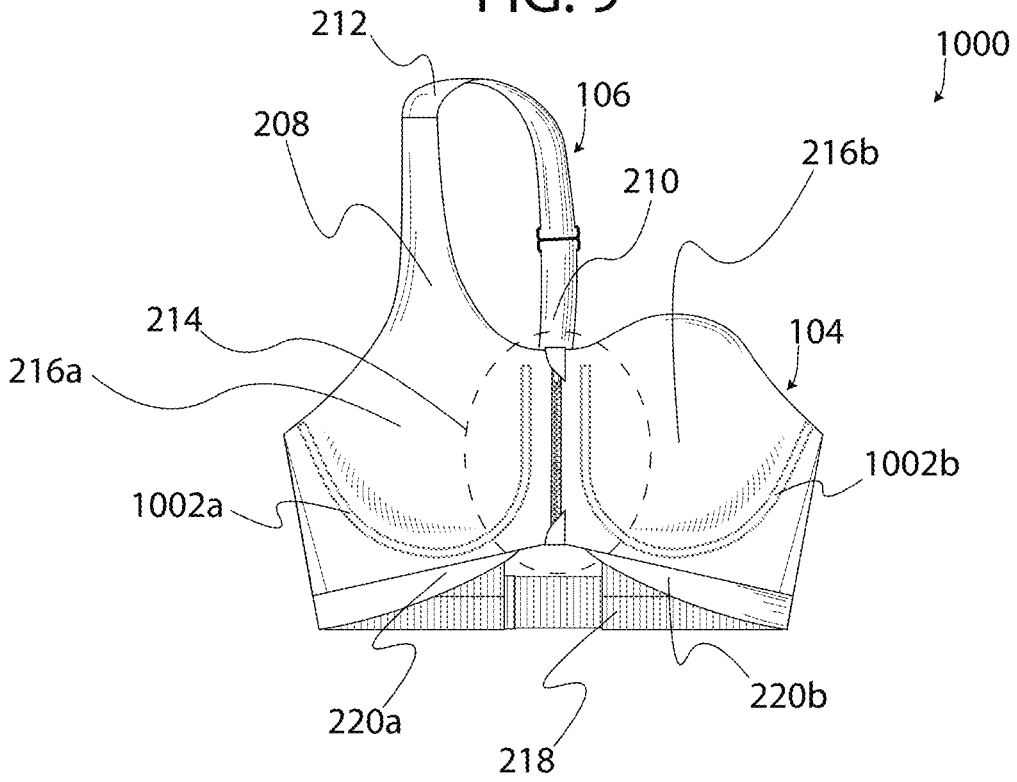
FIG. 10 illustrates a front view of the medical garment.
Figure 11:
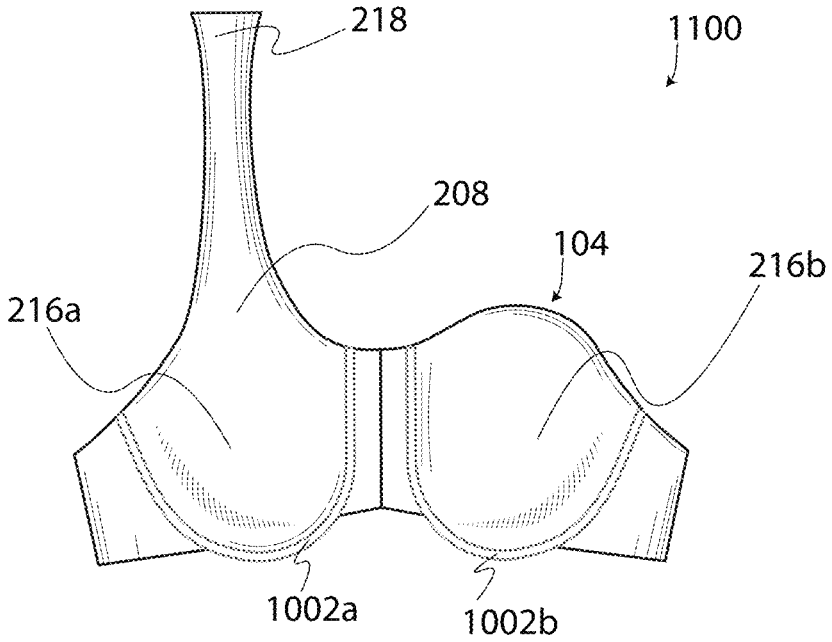
FIG. 11 illustrates another front view of the medical garment.

Now, FIG. 10 illustrates a front view 1000 of the medical garment 104, and FIG. 11 illustrates another front view 1100 of the medical garment 104. In an illustrative configuration, the fabric of the medical garment 104 may include at least one underwire that can be made of, thin, flexible piece of metal, plastic, or resin.

For example, the medical garment 104 may include a first underwire 1002*a* and a second underwire 1002*b*. The first underwire 1002*a* may be nestled between the fabric layers of the first cup 216*a*, and the second underwire 1002*b* may be similarly placed between the fabric layers of the second cup 216*b*. The first underwire 1002*a* and the second underwire 1002*b* may be configured to provide additional support to the breasts of the users. For example, the first underwire 1002*a* and the second underwire 1002*b* may be configured to lift and separate the breasts, distributing their weight evenly across the medical garment 104. Accordingly, this configuration not only improves posture but significantly reduces strain on the shoulders and back, providing a comforting relief from back and shoulder pain for the user.

Along with using at least one underwire, medical garment 104 may include various configurations of the strap 106 to assist in reducing strain on the shoulders of the user, after wearing the medical garment 104. The various configurations of the strap 106 may include a variable width of at least one strap portion of the strap 106, or at least one portion of the strap 106 being formed as a sleeve. Accordingly, such configurations allow enhanced support of the medical garment 104, with reduced strain on the shoulders of the user. This is explained in conjunction with FIGS. 12-15.

Figure 12:
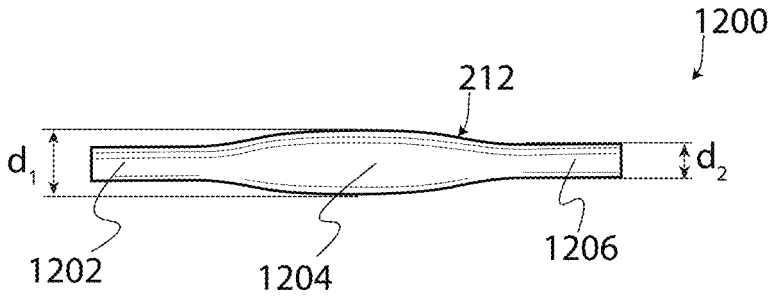
FIG. 12 illustrates a top view of the intermediate strap portion.
Figure 13:
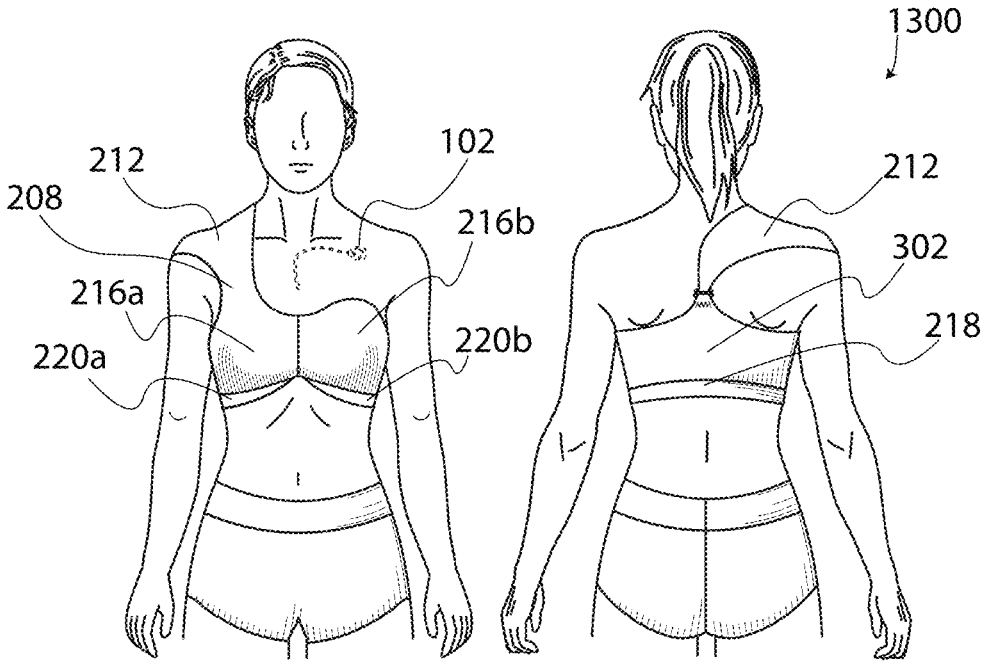
FIG. 13 illustrates a schematic of the user wearing another configuration of the medical garment.
Figure 14:
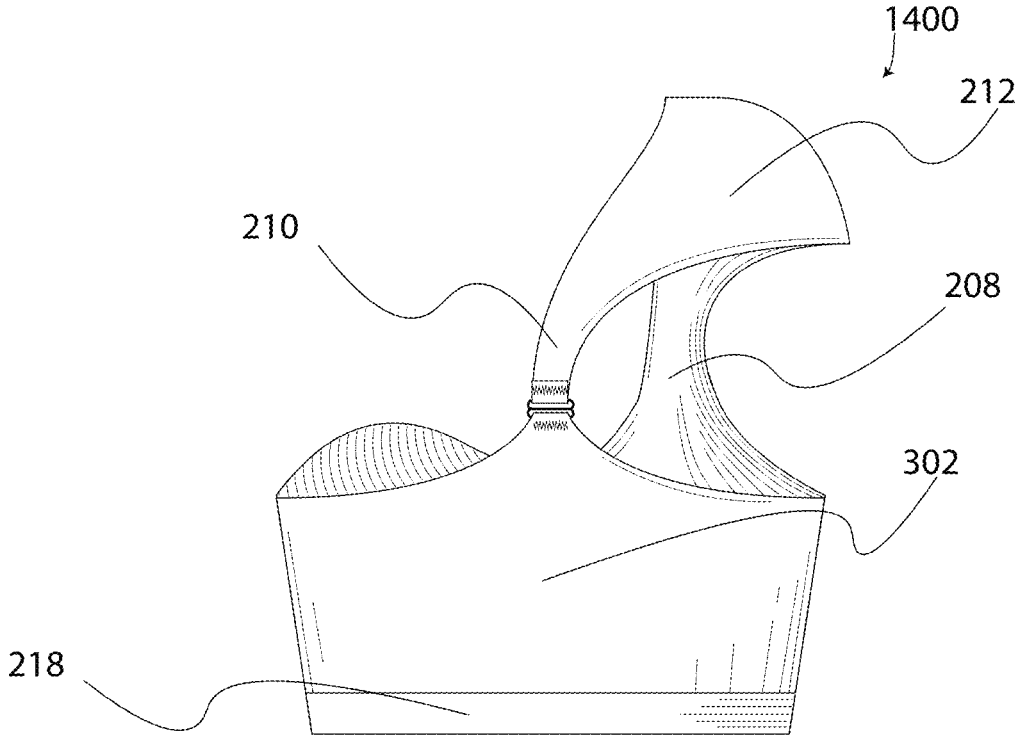
FIG. 14 illustrates a rear view of the medical garment of FIG. 13.
Figure 15:
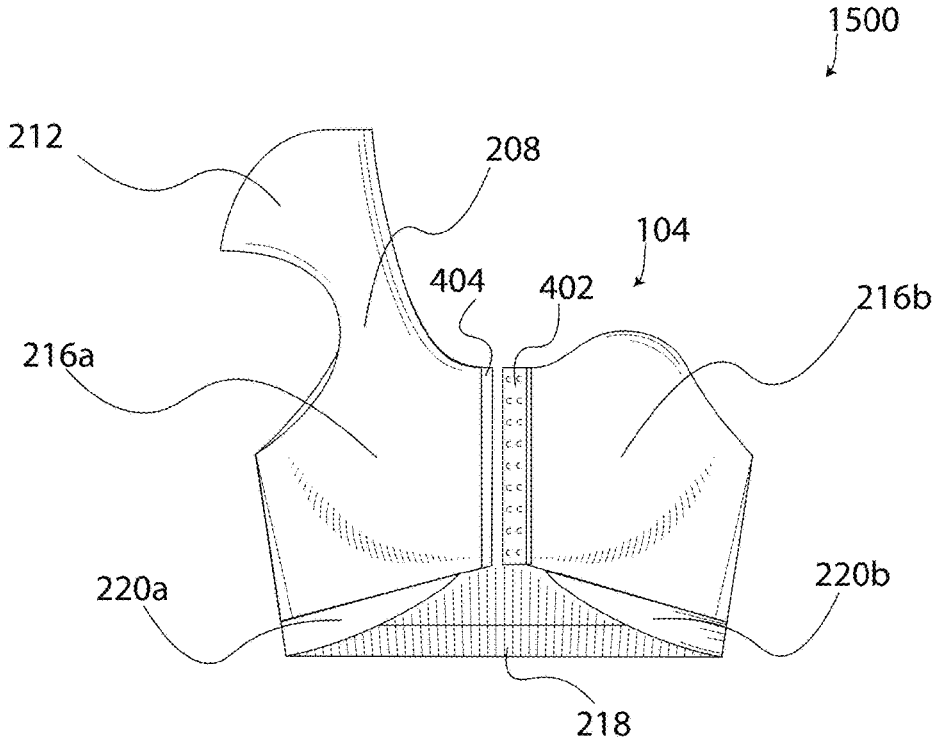
FIG. 15 illustrates a front view of the medical garment of FIG. 13.
Figure 16:
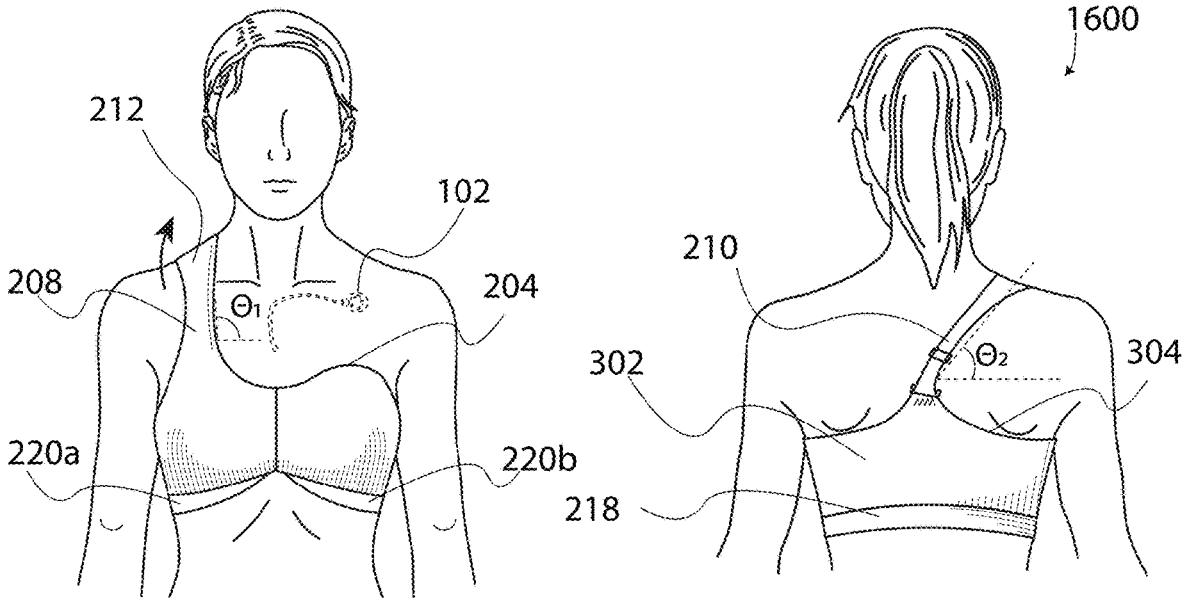
FIG. 16 illustrates another schematic of the user wearing the medical garment.

Now, FIG. 12 illustrates a top view 1200 of the intermediate strap portion 212, FIG. 13 illustrates a schematic 1300 of the user wearing another configuration of the medical garment 104, FIG. 14 illustrates a rear view 1400 of the medical garment 104 of FIG. 13, FIG. 15 illustrates a front view 1500 of the medical garment 104 of FIG. 13, and FIG. 16 illustrates another schematic 1600 of the user wearing the medical garment 104.

In an illustrative configuration, with continuous reference to FIG. 12, the intermediate strap portion 212 may include a first intermediate strap end 1202, a middle intermediate strap portion 1204, and a second intermediate strap end 1206. As such, the first intermediate strap end 1202 may be attached to the first strap portion 208, and the second intermediate strap end 1206 may be attached to the second strap portion 210. Further, the first intermediate strap end 1202 may include a first intermediate strap width ($d_1$), which may be similar to the first strap width of the first strap portion 208. Further, the second intermediate strap end 1206 may include a second intermediate strap width, which may be similar to the first intermediate strap width ($d_1$) and also to a second strap width of the second strap portion 210. Further, the middle intermediate strap portion 1204 may include a middle intermediate strap width ($d_2$), which may be configured to be diverted over the collarbone of the user.

In an illustrative configuration, the middle intermediate strap width ($d_2$) may be greater than the first intermediate strap width ($d_1$) and the second intermediate strap width ($d_1$). For example, the first intermediate strap width ($d_1$) and the second intermediate strap ($d_1$) may range about 0.5-1 inches, whereas the middle intermediate strap width ($d_2$) may range about 1.5-2 inches. As explained earlier, the middle intermediate strap width (d2) may be diverted or disposed over the user's collarbone. Accordingly, as the middle intermediate strap width ($d_2$) may be greater than the first intermediate strap width ($d_1$) and the second intermediate strap ($d_1$), the increased width of the middle intermediate strap portion 1204 may be configured to provide a maximum contact area for the strap 106 to contact with the collarbone portion of the user. Consequently, with a greater contact area, the medical garment 104 may be efficiently supported by the middle intermediate strap width ($d_2$) of the intermediate strap portion 212.

In an illustrative configuration, the intermediate strap portion 212 may be modified or integrated with a shoulder sleeve. The shoulder sleeve may be positioned over the shoulder and deltoid of the user when the user may wear the medical garment 104. Moreover, due to the intermediate strap portion 212 being formed as a shoulder sleeve, the contact area of the intermediate strap portion 212 may be greater than the middle intermediate strap width ($d_2$) of FIG. 12. Hence, due to greater contact area of the intermediate strap portion 212 (in the form of shoulder sleeve), the medical garment 104 may be efficiently supported at the deltoid and shoulder of the user.

The middle intermediate strap portion 1204, the first strap portion 208, the second strap portion 210, and the intermediate strap portion 212 may include a padded strap. The padded strap may be configured to provide a cushioning effect. Accordingly, such cushioning effect may offer extra comfort, especially at the shoulders or the deltoid, when the medical garment 104 is worn by the user.

In an illustrative configuration, to prevent any contact with the surgical site 102 of the user, strap 106 may be diverted over the user's collarbone. As such, the various strap portions of strap 106 may be disposed at various transpose angles, such that ease of diversion of the strap 106 may be resulted. This diversion avoids the contact of the strap 106 with the surgical site 102. This is explained in conjunction with FIG. 16.

Now, FIG. 16 illustrates various views 1600 of the user after wearing the medical garment 104. As explained earlier, the various strap portions of strap 106 may be disposed at various transpose angles, such that ease of diversion of the strap 106 from the surgical site 102 may be resulted. Particularly, the first strap portion 208 may be adjoined to the front panel proximal edge 204 at a first transpose angle $\Theta_1$, and the second strap portion 210 may be adjoined to the rear panel proximal edge 304 at a second transpose angle $\Theta_2$. As such, in the same configuration, the first transpose angle $\Theta_1$ and the second transpose angle $\Theta_2$ may include an acute angle, i.e., an angle ranging about 0°-90°.

In an illustrative configuration, with continued reference to FIG. 16, to divert the strap 106 through the collarbone distal or away from the surgical site 102, the first transpose angle $\Theta_1$ may be formed at an angle greater than the second transpose angle $\Theta_2$, i.e. $\Theta_1>\Theta_2$. Accordingly, the first transpose angle $\Theta_1$ may be perpendicular, i.e., about 90°. Hence, the first strap portion 208 may be perpendicular to the front panel proximal edge 204. As a result, the intermediate strap portion 212 may be diverted over the collarbone distal to the surgical site 102 of the user.

In an illustrative configuration, to provide adequate lift or support to the front panel 202, strap 106 may be attached to a center portion of the rear panel 302 at the second transpose angle $\Theta_2$. Particularly, the second strap portion 210 may be attached to the center of the rear panel 302. In such configurations, the second transpose angle $\Theta_2$ may be less than the first transpose angle $\Theta_1$ ($\Theta_2<90°$). Therefore, the second strap portion 210 may be configured to lift the medical garment 104 about the center of the rear panel 302, and hence, equal lift and support may be provided to all portions of the rear panel 302. The first transpose angle $\Theta_1$ and the second transpose angle $\Theta_2$, in addition to the front panel 202, the rear panel 302, and the strap 106, may be configured to provide enhanced comfort and support the user's breasts.

As the surgical site 102 may be located on the right portion of the chest of the user, the current configuration of the medical garment 104 may include diversion of the strap 106 over the left portion of the chest of the user. As may be appreciated, the second transpose angle $\Theta_2$ and the first transpose angle $\Theta_1$, as well as the positioning of the first strap portion 208 may be modified such that the strap 106 may be diverted away from the surgical site 102 at the right portion of the chest of the user. For example, the first strap portion 208 may be formed at the second cup 216*b*, and the first transpose angle Gi may be reduced such that the strap 106 may be diverted away from the surgical site 102 at the right portion of the chest of the user.

In an illustrative configuration, the medical garment 104 may be formed as a multi-layered fabric structure. The multi-layered fabric structure may be configured to provide better opacity, coverage, sweat-absorbing properties, and increased durability to the medical garment 104. The multi-layered fabric structure may be formed of materials such as, but not limited to, spandex, lace, polyester, nylon, microfiber, cotton, and the like. The multi-layered structure is explained in detail, in conjunction with FIGS. 17-18.

Figure 17:
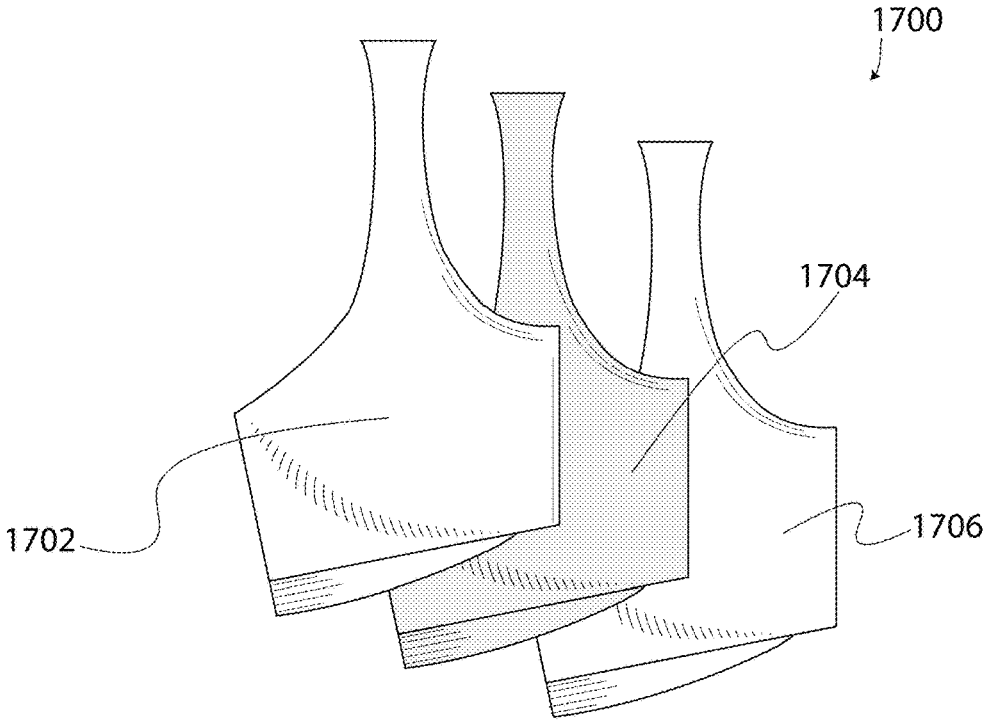
FIG. 17 illustrates a perspective view of a portion of the medical garment having a multi-layered fabric structure.
Figure 18:
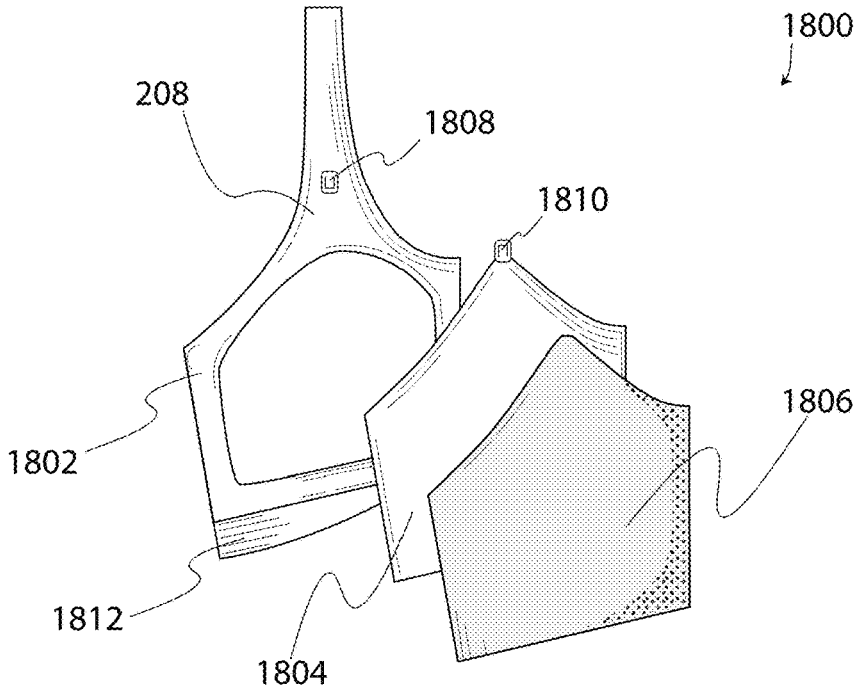
FIG. 18 illustrates a perspective view of another configuration of the medical garment having a multi-layered fabric structure.

Now, FIG. 17 illustrates a perspective view 1700 of a portion of the medical garment 104 with a multi-layered fabric structure, and FIG. 18 illustrates a perspective view 1800 of another configuration of the medical garment 104 having the multi-layered fabric structure.

In an illustrative configuration, with continued reference to FIGS. 17-18, the medical garment 104 may be formed of a multi-layered structure. For example, medical garment 104 may include a first fabric layer 1702, an intermediate fabric layer 1704, and a second fabric layer 1706. Further, the first fabric layer 1702 may represent an outer layer of the medical garment 104, and the second fabric layer 1706 may represent the layer of the 104 which may contact the user's skin. Therefore, the intermediate fabric layer 1704 may be disposed between the first fabric layer 1702 and the second fabric layer 1706.

In an illustrative configuration, the first fabric layer 1702 and the second fabric layer 1706 may be formed of materials such as but not limited to a combination of polymer and spandex, for example, about 86-88% polyamide and about 12-14% spandex. Further, intermediate fabric layer 1704 may be formed as a foam material, such as foam padding having a thickness ranging from about 3-5 mm. Therefore, the material composition of the first fabric layer 1702, the intermediate fabric layer 1704, and the second fabric layer 1706 ensures durability, ease in recovery, elasticity, and the like.

In an illustrative configuration, alternatively, such a multi-layered fabric structure may be formed for medical garments 104, such as a nursing brassiere. With continued reference to FIG. 18, the medical garment 104 illustrated herein may include a nursing brassiere. Further, the medical garment 104 may include an a-frame 1802 formed with the first strap portion 208 as a first layer, a second layer 1804, and a fastener-compatible layer 1806 integrated with the second layer 1804. Further, the a-frame 1802 and the second layer 1806 may be adjoined together using one or more nursing clips, which is explained hereinafter.

In an illustrative configuration, the a-frame 1802 may be adjoined to the second layer 1804 using one or more clip-down nursing clips. For example, the a-frame 1802 may include a nursing hook 1808, and the second layer 1804 may include a nursing clasp 1810. Further, the second layer 1804 may be adjoined, or formed with the a-frame 1802, particularly about an underband 1812 (similar to the first converging portion 220*a* and to the second converging portion 220*b*). Further, the nursing hook 1808 may be configured to engage the nursing clasp 1810 to removably adjoin the second layer 1804 to the a-frame 1802. As may be appreciated, the nursing clasp 1810 may be disengaged from the nursing hook 1808 to pull the second layer 1804 downwards, thereby provisioning the removal of the intermediate layer 1804.

In an illustrative configuration, as explained earlier, the second layer 1804 may be formed with the fastener-compatible layer 1806. The fastener-compatible layer 1806 may be integrated with the second layer 1804 in such a manner that when the nursing clasp 1810 may be disengaged from the nursing hook 1808, the second layer 1804 may be pulled downwards in unison with the fastener-compatible layer 1806. The fastener-compatible layer 1806 may be formed of material such as but not limited to, a microfiber loop fabric, nylon loop fabric, polyester loop fabric, and the like. As the name suggests, the fastener-compatible layer 1806 may enable integration of heating/cooling attachments (illustrated in FIG. 20) thereon, by using fastening mechanisms such as hook-and-loop, or in other words, a Velcro attachment.

Such arrangements are beneficial for breast-feeding mothers, as to feed their baby, the nursing clasp 1810 may be disengaged from the 1808 to expose the nipple or breast of the mother to the baby. Accordingly, such multi-layered fabric, and nursing clips may not be limited to single-strap medical garments 104. The multi-layered fabric structure along with the nursing clips may also be formed in medical garments 104 such as two-strap brassieres. This is explained in FIG. 19.

Figure 19:
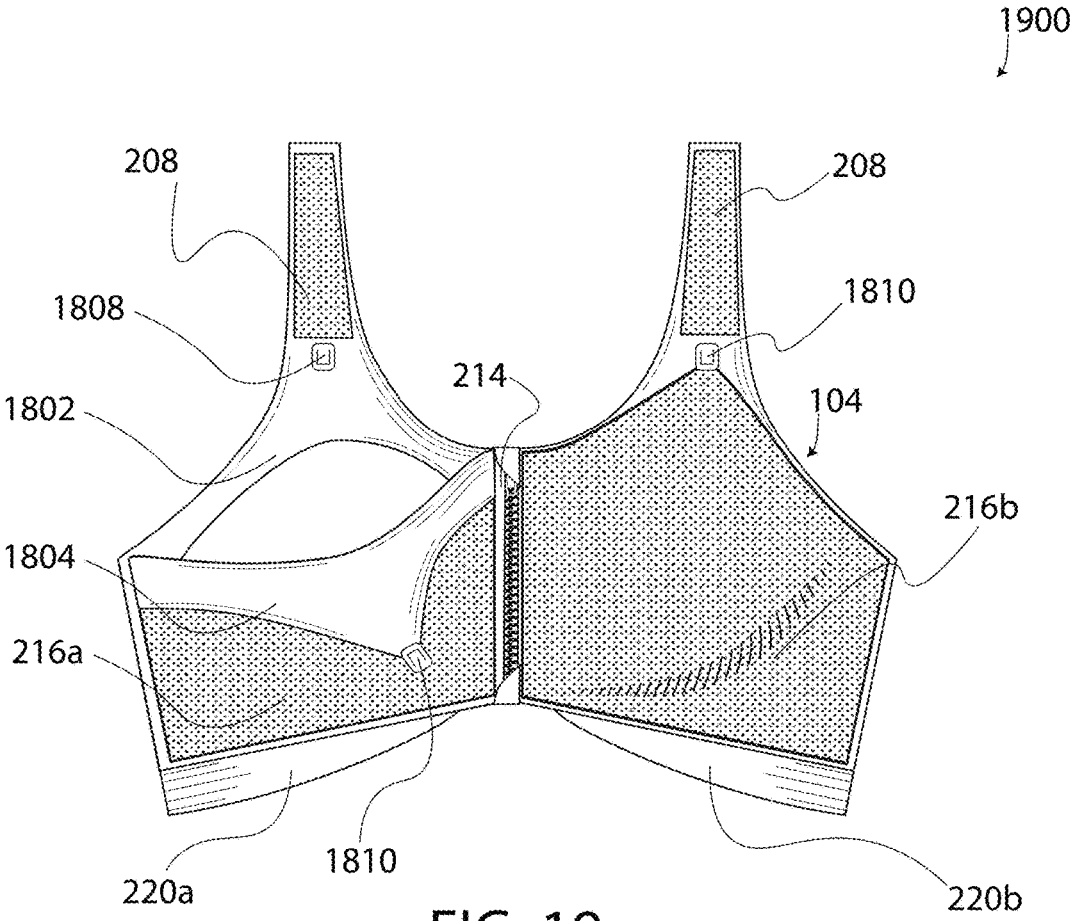
FIG. 19 illustrates a front view of a medical garment such as a two-strap brassiere.

Now, FIG. 19 illustrates a front view 1900 of a medical garment 104, which may include a two-strap brassiere. Further, similar to the medical garment 104 illustrated in FIG. 18, the medical garment 104 illustrated herein may include a multi-layered fabric structure. For example, the medical garment 104 may include two a-frames 1802, and the second layer 1804 for both the first cup 216*a* and the second cup 216*b*. The second layer 1804 for each cup may be integrated with the fastener-compatible layer 1806. As seen in the figure, each a-frame 1802 may be equipped with nursing clips. For example, the a-frame 1802 of the first cup 216*a* and the second cup 216*b* may include the nursing hook 1808. Further, the second layer 1804 of the first cup 216*a* and the second cup 216*b* may include the nursing clasp 1810. Accordingly, to adjoin the second layer 1804 to the a-frames 1802, the nursing hook 1808 may be engaged to the nursing clasp 1810. As such, in some configurations, the a-frame 1802, the first cup 216*a*, and the second cup 216*b* may be formed of a material similar to the fastener-compatible layer 1806. Accordingly, the first cup 216*a* and the second cup 216*b* may be fastener compatible, i.e., compatible for receiving and fastening of the heating/cooling attachments thereon, using fastening mechanisms such as hook-and-loop, or in other words, a Velcro attachment.

Now, users such as cancer patients undergoing treatments such as chemotherapy and radiation therapy, along with breast surgery, as well as with the chemotherapy port implant may often experience skin sensitivity, discomfort, and increased risk of pressure sores due to prolonged periods of immobility. To provide relief from such symptoms, physicians and medical practitioners recommend that the medical garment 104 be worn for at least two weeks post-surgery. Additionally, the medical garment 104 may be equipped with at least one cooling attachment. The cooling attachment, upon contact with the user's body, may be configured to provide a therapeutic cooling effect and hence may provide effective relief from inflammation and pressure relief, enhancing overall comfort to improve the quality of life of such users. At least one cooling attachment may be described in detail, in conjunction with FIGS. 20-25.

Figure 20:
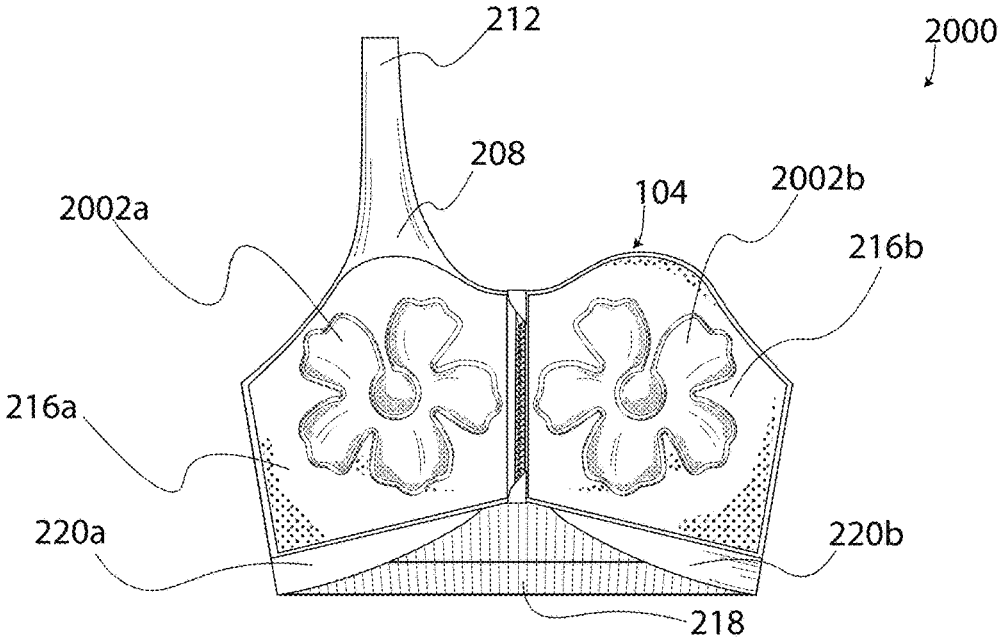
FIG. 20 illustrates a front view of another configuration of the medical garment.

Now, FIG. 20 illustrates a front view 2000 of another configuration of the medical garment 104. In this configuration, the medical garment 104 may be equipped with one or more passive cooling attachments. For example, the passive cooling attachments may include a plurality of cooling attachments 2002*a*, 2002*b* (hereinafter referred to as passive cooling attachments 2002). Each passive cooling attachment from the passive cooling attachments 2002 may be shaped as predefined structures including but not limited to a flower petal-shaped structure, or any geometric structure such as a circular shape, triangular shape, and the like. Further, the passive cooling attachments 2002 may be equipped with one or more types of fasteners, such as hook-based fasteners, hook-and-loop fasteners (as explained earlier, such as Velcro), and the like. One or more types of fasteners may be configured to integrate the passive cooling attachments 2002 to the medical garment 104. Therefore, when worn by the user, the passive cooling attachments 2002 may indirectly contact the body of the user through the medical garment 104 and may provide a cooling effect to the user's body, thereby providing effective reduction of inflammation, pressure relief, and enhancing overall comfort. Further, as may be appreciated, the passive cooling attachments 2002 may also act as a heating attachment, which may be included or integrated for medical garments 104 involving nursing bras. Such heating attachment may be beneficial for breastfeeding users, as the heat provided from the heating attachment may give relief from engorgement, sore and tender breasts, and the like. The passive cooling attachment 2002 is explained in detail in conjunction with FIGS. 21-22.

Figure 21:
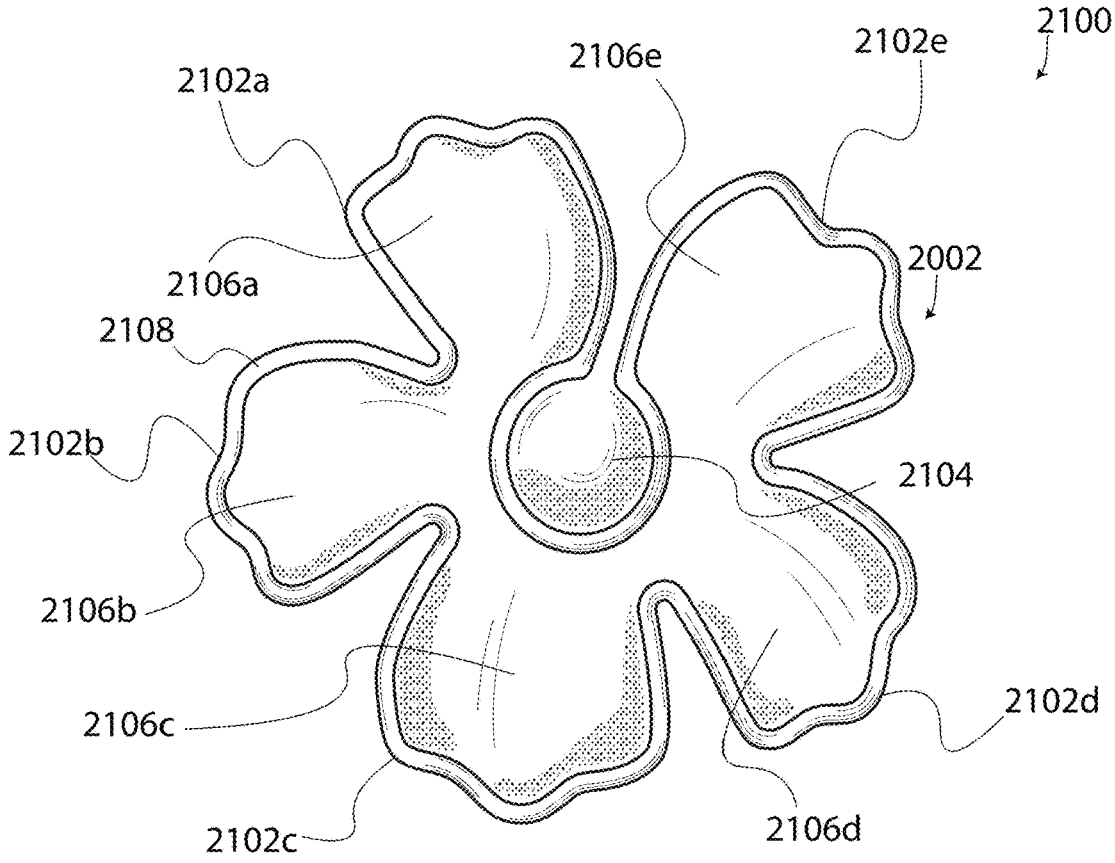
FIG. 21 illustrates a front view of the passive cooling attachment.
Figure 22:
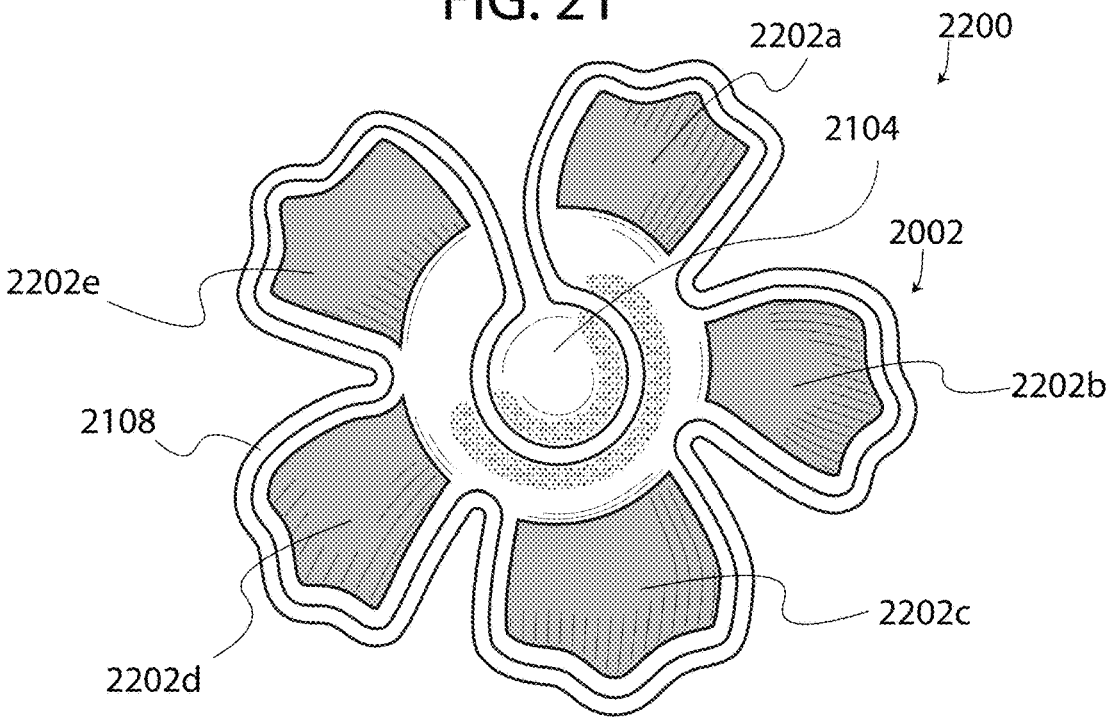
FIG. 22 illustrates a rear view of the passive cooling attachment.

Now, FIG. 21 illustrates a front view 2100 of the passive cooling attachments 2002, and FIG. 22 illustrates a rear view 2200 of the passive cooling attachments 2002. The passive cooling attachments 2002 illustrated in FIGS. 21-22 may be shaped as a flower-petal-based design. The passive cooling attachments 2002 may include a plurality of flaps 2102*a*, 2102*b*, 2102*c*, 2102*d*, and 2102*e* (hereinafter referred to as flaps 2102). Further, flaps 2102 may extend from eye 2104 positioned at the center of the passive cooling attachments 2002. Flaps 2102 may include a front surface 2106*a*, 2106*b*, 2106*c*, 2106*d*, and 2106*e*, and a rear surface 2202*a*, 2202*b*, 2202*c*, 2202*d*, and 2202*e* respectively. For example, the flaps 2102*a*, 2102*b*, 2102*c*, 2102*d*, and 2102*e* may include the front surface 2106*a*, 2106*b*, 2106*c*, 2106*d*, and 2106*e* (hereinafter referred to as front surfaces 2106) and the rear surface 2202*a*, 2202*b*, 22022*c*, 2202*d*, and 2202*e* respectively (hereinafter referred to as rear surfaces 2202). Further, the front surfaces 2106 may be adjoined, or molded to the rear surfaces 2202 about a rim 2108.

In an illustrative configuration, within the flaps 2102, each flap may be separated from the sequential flap by a predefined gap. For example, flap 2102*a* may be separated from the flap 2102*b* by a predefined gap, the flap 2102*b* may be separated from the flap 2102*c* by a similar predefined gap, and the like. The predefined gap may be shaped as, but not limited to a V-shaped gap, a U-shaped gap, and the like. Further, the predefined gap may allow variable orientation of each flap with respect to the sequential flap about the eye 2104.

Further, the front surfaces 2106 and the rear surfaces 2202 may be formed with a durable plastic. Further, the rim 2108 may act as a seal when the front surfaces 2106 and the rear surfaces 2202 may be adjoined. The front surfaces 2106 and the rear surfaces 2202 when adjoined, may form an inner volume. The inner volume may be configured to store a cooling agent, which may include a mixture of water and a polymer such as sodium polyacrylate to form a gel-like fluid consistency. The cooling agent may harden when frozen and may retain cold temperatures effectively. Further, the front surfaces 2106 and the rear surfaces 2202 may be formed with an insulating material in addition to plastic. Such material composition may be effective for retaining temperatures of the gel fluid for a prolonged period.

In an illustrative configuration, the eye 2104 and the rear surfaces 2202 may include one or more attachment structures or fastening mechanisms (not shown in figures). The one or more fastening mechanisms may further include, but are not limited to Velcro attachments, sewn loop-and-hooks, adhesive strips, fabric wraps, and the like. The one or more fastening mechanisms may be configured to attach the eye 2104 and the rear surfaces 2202 to one or more portions of the medical garment 104, such as the first strap portion 208, the first cup 216*a*, the second cup 216*b*, and the like. As may be appreciated, the first cup 216*a* and the second cup 216*b* may be integrated or formed with a fastener-compatible layer (similar to the fastener-compatible layer 1806), which may allow adherence of the passive cooling attachments 2002 with the first cup 216*a* and the second cup 216*b*. Accordingly, the passive cooling attachments 2002 may be interlocked with the medical garment 104. This is explained in detail in conjunction with FIGS. 23-25.

Figure 23:
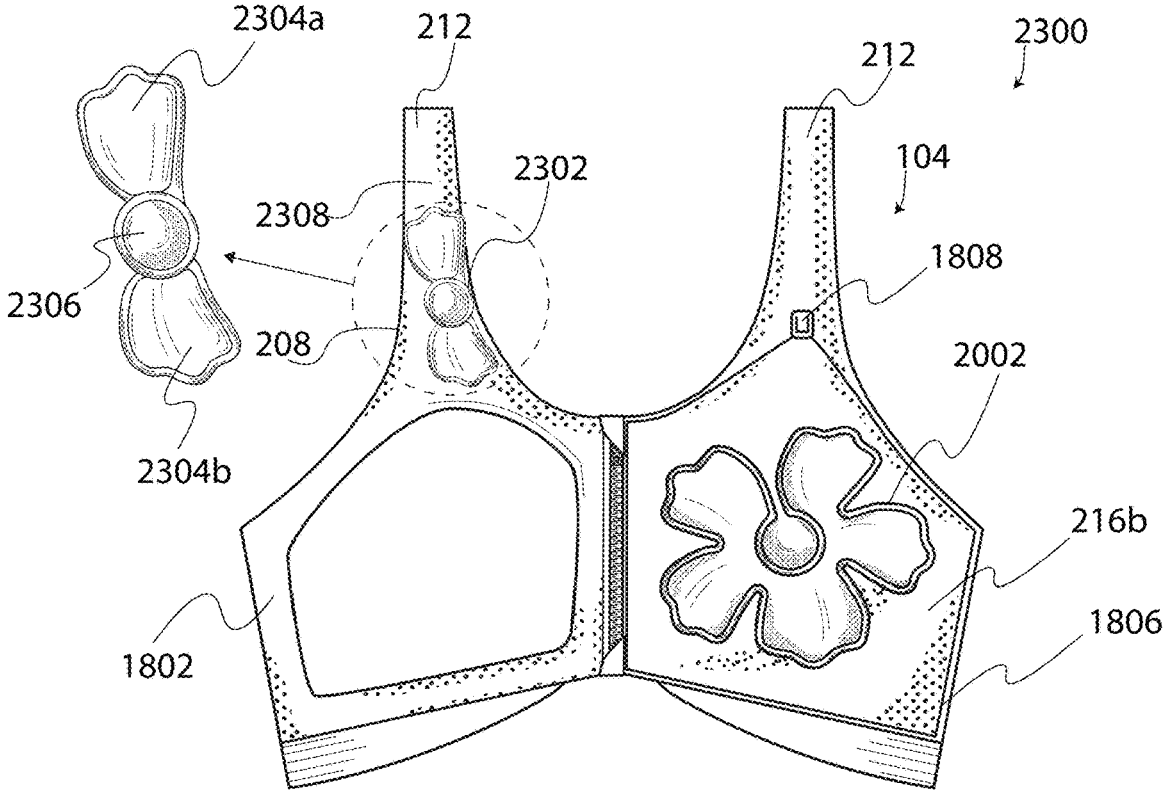
FIG. 23 illustrates a front view of the medical garment equipped with one or more configurations of the passive cooling attachment.
Figure 24:
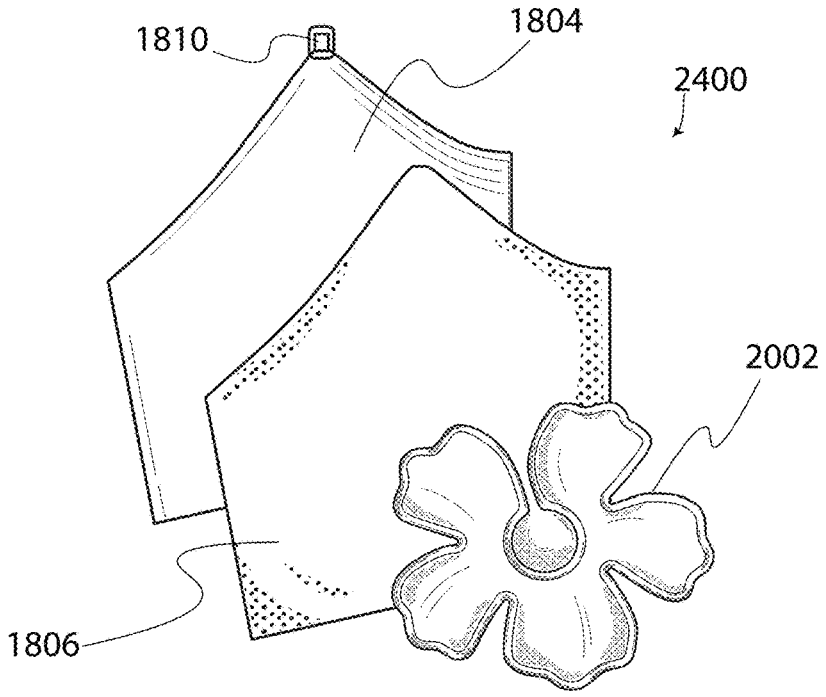
FIG. 24 illustrates a schematic of the passive cooling attachments assembled to a multi-layered structure of the medical garment.
Figure 25:
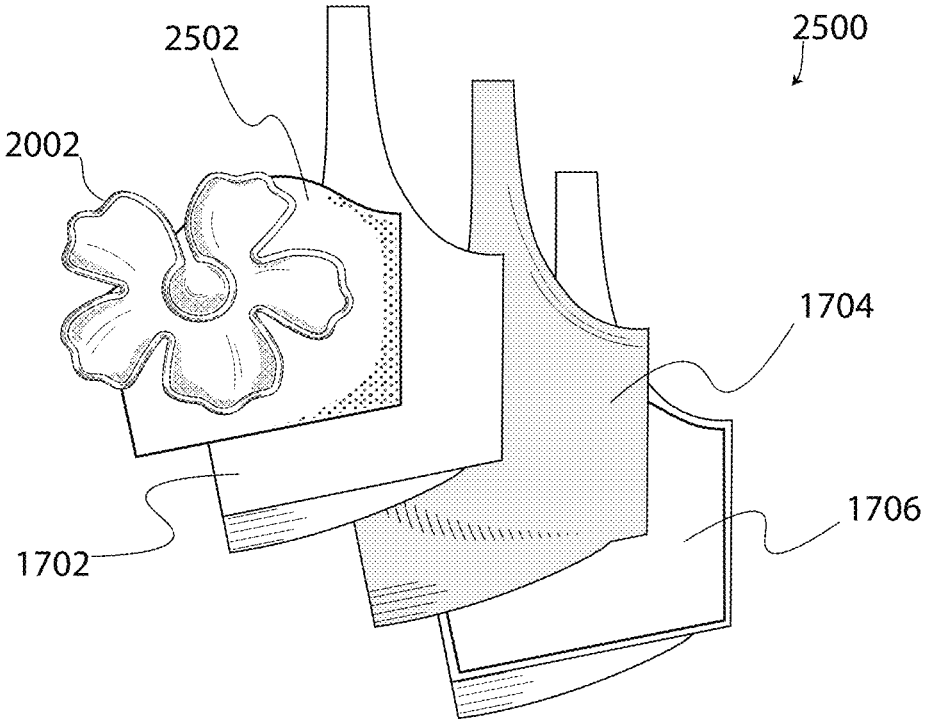
FIG. 25 illustrates another schematic of the passive cooling attachment assembled to a multi-layered structure of the medical garment.

In an illustrative configuration, FIG. 23 illustrates a front view 2300 of the medical garment 104 equipped with one or more configurations of the passive cooling attachments 2002, FIG. 24 illustrates a schematic 2400 of the passive cooling attachments 2002 assembled to a multi-layered structure of the medical garment 104, and FIG. 25 illustrates another schematic 2500 of the passive cooling attachments 2002 assembled to a multi-layered structure of the medical garment 104.

In an illustrative configuration, with continued reference to FIGS. 23-25, the medical garment 104 may include at least one passive cooling attachment 2002. As such, the passive cooling attachments 2002 may be configured in one or more configurations. For example, a passive cooling attachment 2302 (similar to the passive cooling attachments 2002) may be fixated to a front surface 2308 of the strap. In such configuration, the passive cooling attachments 2302 may include an eye 2306, a first flap 2304*a*, and a second flap 2304*b* extending therefrom. As such, the eye 2306 may be integrated with the fastening mechanism, which may be configured to attach the passive cooling attachment 2302 to a front surface 2308 of the first strap portion 208.

The passive cooling attachment 2302 may also be integrated with any portion of the a-frame 1802. Additionally, passive cooling attachments 2002 may be attached to the second cup 216*b* in a similar fashion as depicted in FIG. 20. Therefore, integrating multiple passive cooling attachments 2002 on the medical garment 104 may enable therapeutic cooling of one or more body parts of the user. Once the need for therapeutic cooling may be completed, the passive cooling attachments 2002 may be removed by un-fastening the fastening mechanism. For medical garments 104 such as the nursing brassiere, the passive cooling attachments 2002 integrated with the second cup 216*b* may be clipped down or disengaged along with the second cup 216*b* by disengaging the nursing clip or nursing hook 1808.

In an illustrative configuration, with continued reference to FIG. 25, to attach the passive cooling attachment 2002 externally to a medical garment 104 formed of multiple-layered configuration, a fabric layer 2502 may be formed as first fabric layer 1702. The fastener layer 2502 may be formed of material such as, but not limited to fastener-compatible fabric, microfibers, nylon, cotton-polymer, and the like. Such fastener layer 2502 may be integrated with the passive cooling attachments 2002. Accordingly, the passive cooling attachment 2002 may be fastened to the fastener layer 2502.

In an illustrative configuration, the passive cooling attachments 2002 may also be attached to medical garments 104 such as compression vests, post-surgical vests, or post-surgical trousers. Compression vests or post-surgical garments may be configured to support and compress the chest and abdominal areas post-surgery. Further, post-surgical trousers aid in the recovery process following various types of surgeries, particularly those involving the lower body, abdomen, or hips. FIGS. 26-33 illustrate the compression vests in detail hereinafter.

Figure 26:
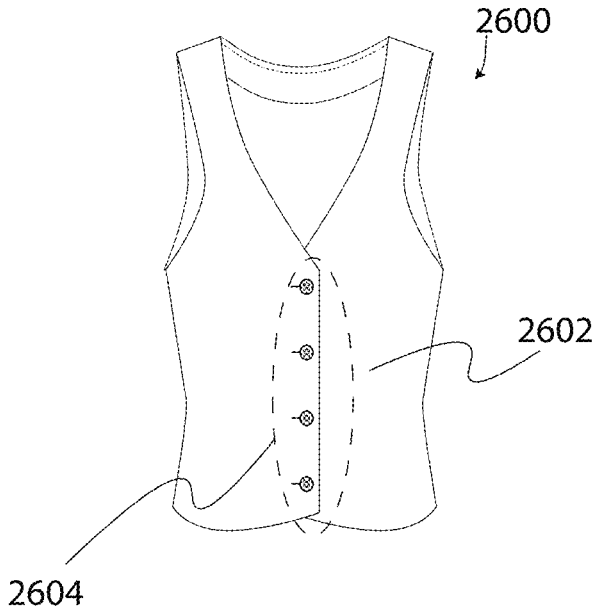
FIG. 26 illustrates a front view of a compression vest.
Figure 27:
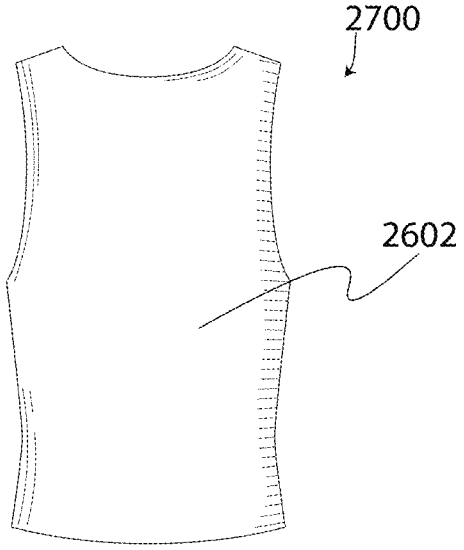
FIG. 27 illustrates a rear view of the compression vest.
Figure 28:
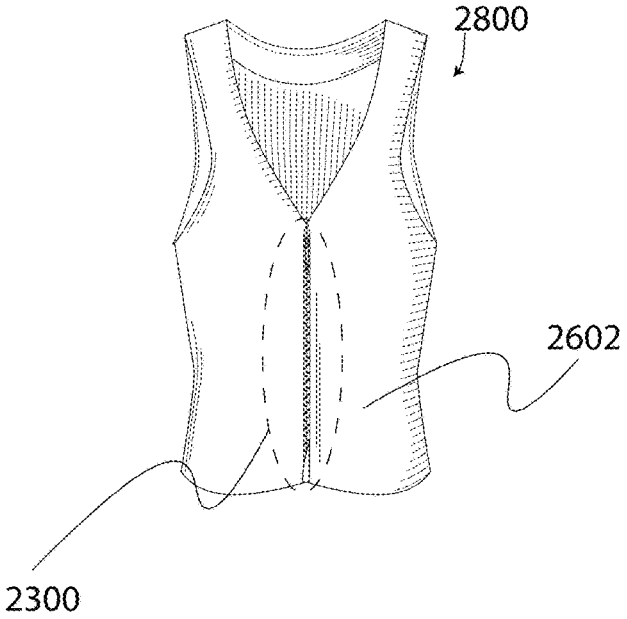
FIG. 28 illustrates a front view of another configuration of the compression vest.
Figure 29:
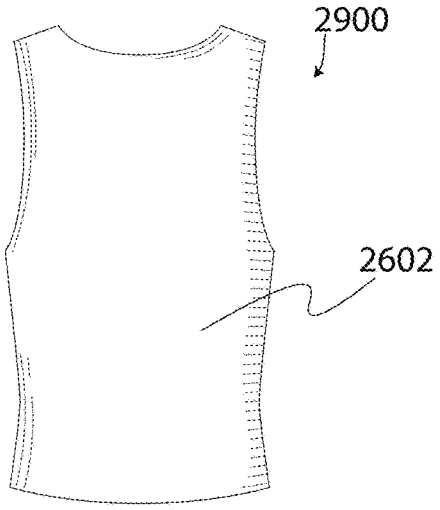
FIG. 29 illustrates a rear view of another configuration of the compression vest.
Figure 30:
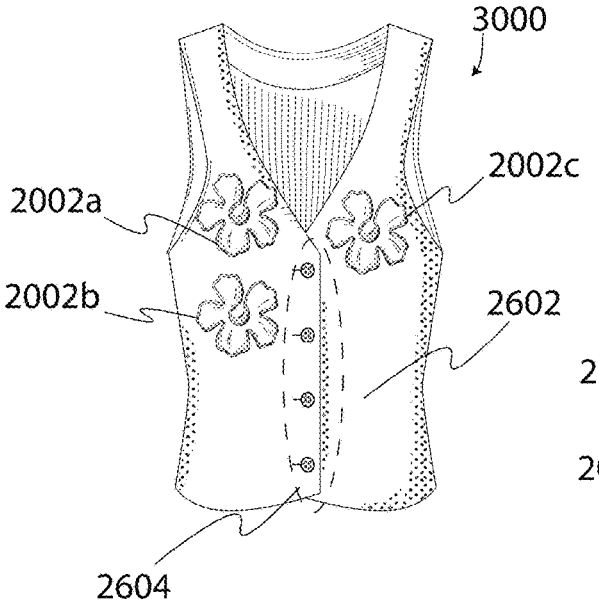
FIG. 30 illustrates a front view of another configuration of the compression vest integrated with the passive cooling attachment.
Figure 31:
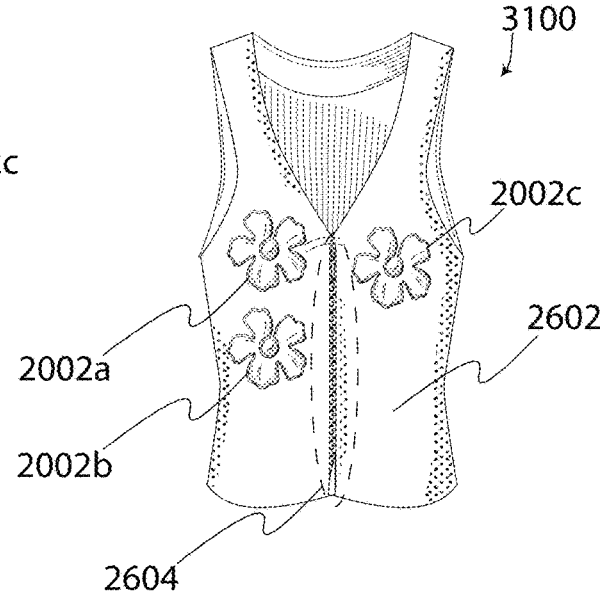
FIG. 31 illustrates a front view of another configuration of the compression vest integrated with the passive cooling attachment.

Now, FIG. 26 illustrates a front view 2600 of a compression vest, FIG. 27 illustrates a rear view 2700 of the compression vest, FIG. 28 illustrates a front view 2800 of another configuration of the compression vest, FIG. 29 illustrates a rear view 2900 of another configuration of the compression vest, FIG. 30 illustrates a front view 3000 of another configuration of the compression vest integrated with the passive cooling attachment, FIG. 31 illustrates a front view 3100 of another configuration of the compression vest integrated with the passive cooling attachment.

In an illustrative configuration, with continued reference to FIGS. 28-31, the medical garment 104 may include the compression vests. As explained earlier, such medical garments may be configured to provide post-surgery support and compression to the chest and abdominal areas. The medical garment 104 herein may include a torso body 2602 with a front closure mechanism 2604, which may include but is not limited to button closures, zipper mechanism, hook-and-loop mechanism, and the like. For example, the medical garment 104 of FIGS. 26-27 may include the front closure mechanism 2604 being a button closure and the medical garment 104 of FIGS. 28-29 may include the front closure mechanism 2604 as a zipper mechanism.

In an illustrative configuration, medical garment 104 of FIGS. 26-27 may be integrated with at least one passive cooling attachment. For example, referring to FIGS. 30-31, it may be seen that the torso body 2602 may be integrated with a plurality of cooling attachments 2002*a*, 2002*b*, and 2002*c*. It must be noted that the plurality of cooling attachments 2002*a*, 2002*b*, and 2002*c* may be attached to the medical garment 104 similar to the passive cooling attachments 2002, as explained in FIGS. 20-25, i.e., the torso body 2602 may also be formed of fastener compatible layer similar to the fastener-compatible layer 1806. —

Figure 32:
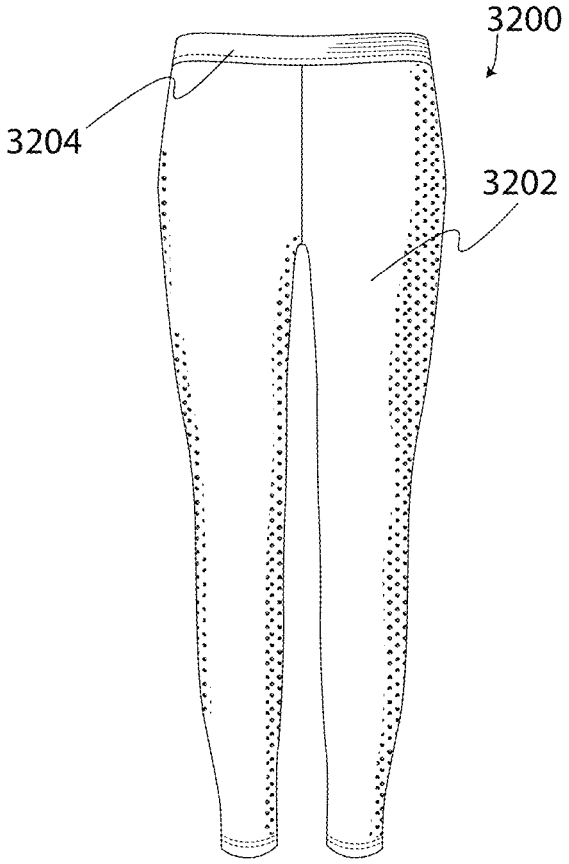
FIG. 32 illustrates a front view of a post-surgery trouser.
Figure 33:
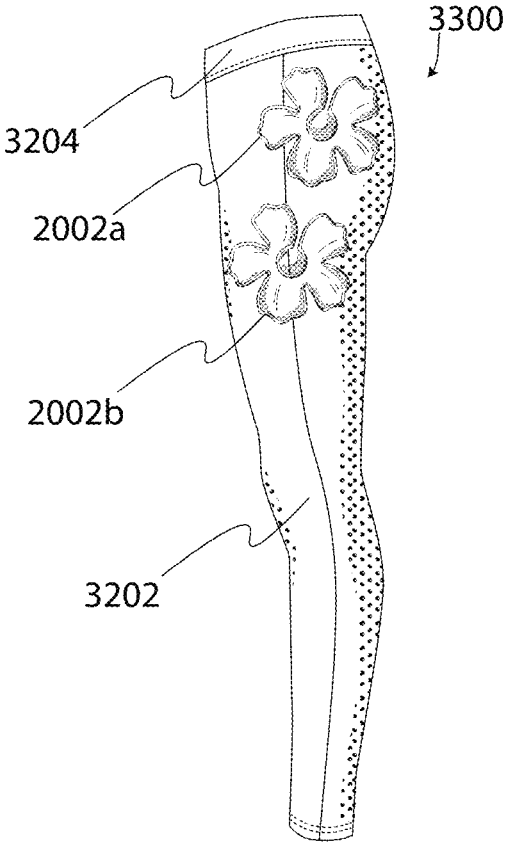
FIG. 33 illustrates a side view of the post-surgery trousers integrated with the passive cooling attachment.

Now, FIG. 32 illustrates a front view 3200 of a medical garment, such as post-surgical trousers, and FIG. 33 illustrates a side view 3300 of the post-surgical trousers. As explained earlier, post-surgical trousers aid in the recovery process following various types of surgeries, particularly those involving the lower body, abdomen, or hips.

In an illustrative configuration, with continued reference to FIGS. 32-33, the medical garment 104 herein may include a pair of leggings 3202 integrated with a waistband 3204, formed as an elastic waistband integrated with closures such as but not limited to zippered, hook & loop, and/or hook & clasp, or button closures, and the like. Further, the medical garment 104 may be manufactured from materials, such as but not limited to nylon and elastic, with anti-bacterial coatings, as well as fastener-compatible fabric (similar to the fabric of the fastener-compatible layer 1806). Further, the medical garment 104, similar to the medical garment 104 described in the aforementioned configurations may also be integrated with at least one passive cooling attachment. For example, referring to FIG. 33, the leggings 3202 may be integrated with a plurality of cooling attachments 2002*a* and 2002*b*. Moreover, it must be noted that the plurality of cooling attachments 2002*a* and 2002*b*, may be attached to the medical garment 104 similarly to the passive cooling attachments 2002 explained in FIGS. 20-25.

Figure 34:
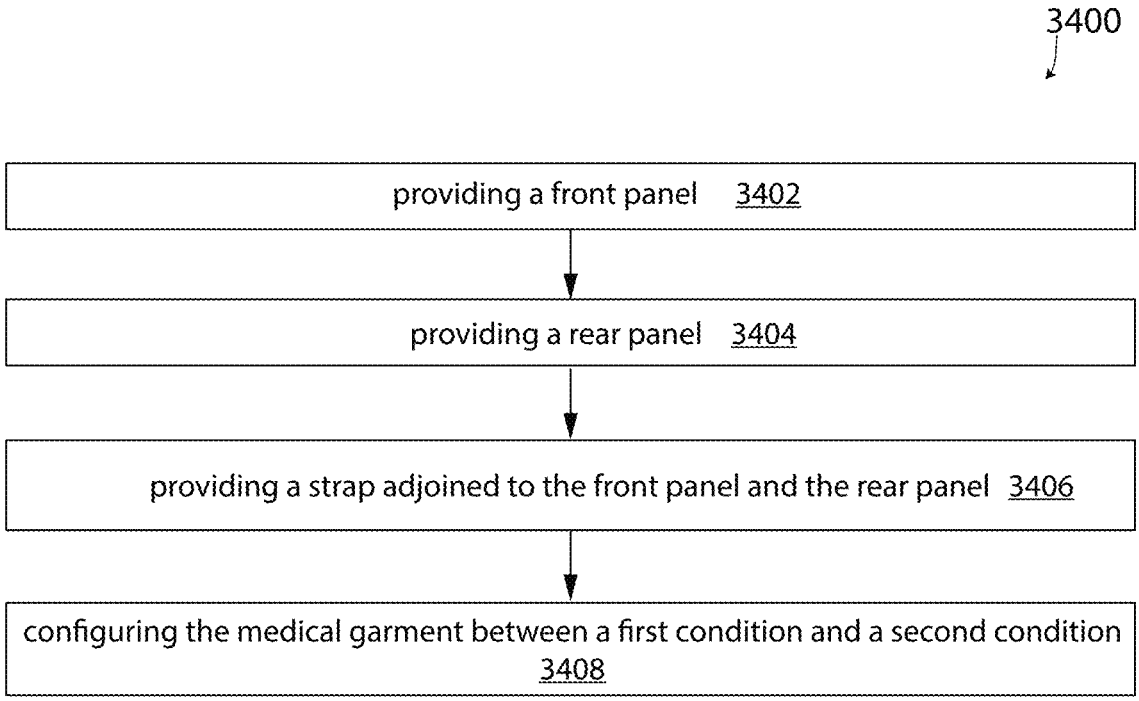
FIG. 34 illustrates a flowchart of a contact prevention method.

Now, FIG. 34 illustrates a flowchart 3400 of a contact prevention method. The contact prevention method may be performed via various steps described hereinafter to configure the medical garment 104 in various conditions to prevent contact of any portion thereof with the user's surgical site.

At step 3402, a front panel 202 may be provided. The front panel 202 may include a front panel proximal edge 204, a front panel distal edge 206 oppositely disposed to the front panel proximal edge 204, and a front closure portion 214 disposed between the front panel proximal edge 204 and the front panel distal edge 206. Further, the front panel 202 may also include a first cup 216*a*, and the second cup 216*b*. The front closure portion 214 may act as a fastening system between the first cup 216*a* and a second cup 216*b*. For example, when the user wears the medical garment 104, the front closure portion 214 may be configured to adjoin the first cup 216*a* and the second cup 216*b*. The front closure portion 214 may include but is not limited to a hook and clasp mechanism, a zipper mechanism, a hook and loop mechanism, and the like. This is already explained in detail in conjunction with FIGS. 2-3.

At step 3404, a rear panel 302 may be provided. The rear panel 302 may be attached to the front panel 202 via a seaming attachment. Further, the rear panel 302 may include a rear panel proximal edge 304, a rear panel distal edge 306 oppositely disposed to the rear panel proximal edge. Further, the rear panel 302 may also include a rear closure portion 702 disposed between the rear panel proximal edge 304 and the rear panel distal edge 306. The rear closure portion 702 may include but is not limited to a hook and clasp mechanism, a zipper mechanism, a hook and loop mechanism, and the like. This is already explained in detail in conjunction with FIGS. 2-3.

At step 3406, a strap 106 may be provided. The strap 106 may include a first strap portion 208 connected to the front panel proximal edge 204 at a first transpose angle 9*i*. Further, the first strap portion 208 may include a first strap width. Further, strap 106 may include a second strap portion 210 connected to the rear panel proximal edge 304, a second transpose angle $\Theta_2$. As such, in the same configuration, the first transpose angle $\Theta_1$ and the second transpose angle $\Theta_2$ may include an acute angle, i.e., an angle ranging about 0°-90°. Further, the second strap portion 210 may include a second strap width. Further, strap 106 may include an intermediate strap portion 212 disposed between the first strap portion 208 and the second strap portion 210. The intermediate strap portion 212 may include an intermediate strap width to cover the user's shoulder. This is already explained in detail in conjunction with FIG. 16.

At step 3408, the medical garment 104 may be configured between a first condition and a second condition. In the first condition, the medical garment 104 is readily worn by a user. In the second condition, the intermediate strap portion 212 is diverted over a collarbone distal to a surgical site 102 positioned at the user's chest, such that contact of the strap 106 with the surgical site is prevented. For example, to divert the strap 106 through the collarbone distal or away from the surgical site 102, the first transpose angle $\Theta_1$ may be formed at an angle greater than the second transpose angle $\Theta_2$, i.e. $\Theta_1>\Theta_2$. Accordingly, the first transpose angle $\Theta_1$ may be perpendicular, i.e., about 90°. Hence, the first strap portion 208 may be perpendicular to the front panel proximal edge 204. As a result, the intermediate strap portion 212 may be diverted over the collarbone distal to the surgical site 102 of the user. This is already explained in detail in conjunction with FIG. 16.

As used herein, including in the claims, "and" as used in a list of items prefaced by "at least one of" indicates that any combination of the listed items may be used. For example, a list of "at least one of A, B, and C" includes any of the combinations A or B or C or AB or AC or BC and/or ABC (i.e., A and B and C). Furthermore, to the extent that more than one occurrence or use of the items A, B, or C is possible, multiple uses of A, B, and/or C may form part of the contemplated combinations. For example, a list of "at least one of A, B, and C" may also include AA, AAB, AAA, BB, etc.

While illustrative and presently preferred configurations of the disclosed systems, methods and/or machine-readable media have been described in detail herein, it is to be understood that the inventive concepts may be otherwise variously embodied and employed and that the appended claims are intended to be construed to include such variations except as limited by the prior art. While the principles of the disclosure have been described above in connection with specific apparatuses and methods, it is to be clearly understood that this description is made only by way of example and not as limitation on the scope of the disclosure.

What is claimed is:

1. A medical garment, comprising:

a front panel comprising:
- a front panel proximal edge;
- a first cup;
- a second cup adjacent to the first cup;
- a front panel distal edge oppositely disposed to the front panel proximal edge; and
- a front closure system disposed between the front panel proximal edge and the front panel distal edge;

a rear panel attached to the front panel, the rear panel comprising:
- a rear panel proximal edge;
- a rear panel distal edge oppositely disposed to the rear panel proximal edge; and
- a rear closure system disposed between the rear panel proximal edge and the rear panel distal edge;

a strap comprising:
- a first strap portion connected to the front panel proximal edge;
- wherein the first strap portion comprises:
  - a first strap width;
- a second strap portion connected to the rear panel proximal edge;
- wherein the second strap portion comprises:
  - a second strap width; and
- an intermediate strap portion disposed between the first strap portion and the second strap portion, the intermediate strap portion comprising:
  - an intermediate strap width to cover a shoulder of a user, the intermediate strap width is greater than the first strap width and the second strap width;

a fastener-compatible layer formed on the first cup and the second cup; and a passive cooling attachment removably, and externally attached to the fastener-compatible layer;

wherein the medical garment is configurable between:

a first condition, wherein the medical garment is readily worn by a user; and a second condition after the first condition, wherein the intermediate strap portion is diverted over a collarbone distal to a surgical site at a chest of the user, such that a contact of the strap with the surgical site is prevented.

2. The medical garment of claim 1, and further comprising:

a first transpose angle formed between the first strap portion and the front panel proximal edge; and a second transpose angle formed between the second strap portion and the rear panel proximal edge, wherein:

the first transpose angle is greater than the second transpose angle.

3. The medical garment of claim 1, wherein the front panel further comprises:

at least one enclosure, each enclosure configured to accommodate a mastectomy form.

4. The medical garment of claim 1, wherein the intermediate strap portion comprises:

a sleeve portion integrated thereto to cover a deltoid portion of the shoulder.

5. The medical garment of claim 1 and further comprising:

an under-band attached to the front panel and the rear panel, the under-band comprising:

a rear portion attached to the rear panel distal edge, wherein the rear portion is formed as a linear structure, and a front portion attached to the front panel distal edge, wherein the front portion is formed as a converging structure.

6. A contact prevention method for preventing contact of a portion of a medical garment with a surgical site of a user, the contact prevention method comprising:

providing a front panel, the front panel comprising:

a front panel proximal edge;

a first cup;

a second cup adjacent to the first cup; and a front panel distal edge oppositely disposed to the front panel proximal edge;

a front closure system disposed between the front panel proximal edge and the front panel distal edge;

providing a rear panel, wherein the rear panel is attached to the front panel, the rear panel comprising:

a rear panel proximal edge;

a rear panel distal edge oppositely disposed to the rear panel proximal edge;

and a rear closure system disposed between the rear panel proximal edge and the rear panel distal edge;

providing a strap, the strap comprising:

a first strap portion connected to the front panel proximal edge;

wherein the first strap portion comprises:

a first strap width;

a second strap portion connected to the rear panel proximal edge;

wherein the second strap portion comprises:

a second strap width; and an intermediate strap portion disposed between the first strap portion and the second strap portion, the intermediate strap portion comprising:

an intermediate strap width to cover a shoulder of a user, the intermediate strap width is greater than the first strap width and the second strap width;

providing a fastener-compatible layer formed on the first cup and the second cup;

providing a passive cooling attachment removably, and externally attached to the fastener-compatible layer; and configuring the medical garment between:

a first condition, wherein the medical garment is readily worn by a user; and a second condition after the first condition, comprising:

diverting the intermediate strap portion, wherein the intermediate strap portion is configured to be diverted over a collarbone distal to a surgical site at a chest of the user, for preventing a contact of the strap with the surgical site.

7. The contact prevention method of claim 6, wherein providing the strap further comprises:

the strap further comprising:

a first transpose angle formed between the first strap portion and the front panel proximal edge; and a second transpose angle formed between the second strap portion and the rear panel proximal edge, wherein:

the first transpose angle is greater than the second transpose angle.

8. The contact prevention method of claim 6, wherein at least one of providing the front panel and providing the rear panel further comprises:

at least one of the rear panel and the front panel comprising:

a multi-layered structure, the multi-layered structure comprising:

a set of outer layers removably attached to at least one of the first strap portion and the second strap portion, the set of outer layers forming an inner volume therebetween to accommodate an inner fabric layer.

9. The contact prevention method of claim 6, wherein providing the front panel comprising at least one enclosure, each enclosure configured to accommodate a mastectomy form.

10. The contact prevention method of claim 6, wherein providing the strap further comprises:

the intermediate strap portion comprising:

a sleeve portion integrated thereto to cover a deltoid portion of the shoulder.

11. The contact prevention method of claim 6 further comprising:

providing an under-band attached to the front panel and the rear panel, the under-band comprising:

a rear portion attached to the rear panel distal edge, wherein the rear portion is formed as a linear structure, and a front portion attached to the front panel distal edge, wherein the front portion is formed as a converging structure.

* * * * *